US011530469B2

(12) United States Patent
Lu et al.

(10) Patent No.: US 11,530,469 B2
(45) **Date of Patent: *Dec. 20, 2022**

(54) PRESS HARDENED STEEL WITH SURFACE LAYERED HOMOGENOUS OXIDE AFTER HOT FORMING

(71) Applicant: GM GLOBAL TECHNOLOGY OPERATIONS LLC, Detroit, MI (US)

(72) Inventors: Qi Lu, Shanghai (CN); Jianfeng Wang, Nanjing (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 42 days.

This patent is subject to a terminal disclaimer.

(21) Appl. No.: 16/460,369

(22) Filed: Jul. 2, 2019

(65) Prior Publication Data

US 2021/0002746 A1 Jan. 7, 2021

(51) Int. Cl.
*C22C 38/02* (2006.01)
*C22C 38/04* (2006.01)
(Continued)

(52) U.S. Cl.
CPC ..... *C22C 38/02* (2013.01); *C21D 1/18* (2013.01); *C22C 38/04* (2013.01); *C22C 38/22* (2013.01);
(Continued)

(58) Field of Classification Search
CPC ..... C22C 38/02; C22C 38/04; C22C 38/22; C22C 38/24; C22C 38/26; C22C 38/32;
(Continued)

(56) References Cited

U.S. PATENT DOCUMENTS 1,828,325 A 10/1931 Kurz
2,178,281 A 10/1939 Judge
(Continued)

FOREIGN PATENT DOCUMENTS

CA 2378934 A1 9/2003
CN 101270453 A 9/2008
(Continued)

OTHER PUBLICATIONS

Lu, Qi et al, U.S. Appl. No. 16/958,362, filed Jun. 26, 2020 entitled, "Steel for Hot Stamping With Enhanced Oxidation Resistance," 41 pages.

(Continued)

*Primary Examiner* — Jie Yang
(74) *Attorney, Agent, or Firm* — Harness, Dickey & Pierce, P.L.C.

(57) ABSTRACT

A press-hardened steel is provided. The press-hardened steel has an alloy matrix including from about 0.01 wt. % to about 0.35 wt. % carbon, from about 1 wt. % to about 9 wt. % chromium, from about 0.5 wt. % to about 2 wt. % silicon, and a balance of iron. The alloy matrix is greater than or equal to about 95 vol. % martensite. A first layer is disposed directly on the alloy matrix. The first layer is continuous, has a thickness of greater than or equal to about 0.01 μm to less than or equal to about 10 μm, and includes an oxide enriched with chromium and silicon. A second layer is disposed directly on the first layer, and includes an oxide enriched with Fe. Methods of preparing the press-hardened steel are also provided.

17 Claims, 10 Drawing Sheets

(51) Int. Cl.

| | |
|---|---|
| ***C22C 38/22*** | (2006.01) |
| ***C22C 38/24*** | (2006.01) |
| ***C22C 38/32*** | (2006.01) |
| ***C21D 1/18*** | (2006.01) |
| ***C22C 38/26*** | (2006.01) |

(52) U.S. Cl.
CPC ..... *C22C 38/24* (2013.01); *C22C 38/26* (2013.01); *C22C 38/32* (2013.01); *C21D 2211/008* (2013.01); *C21D 2241/00* (2013.01); *C22C 2204/00* (2013.01)

(58) Field of Classification Search
CPC . C22C 2204/00; C21D 1/18; C21D 2211/008; C21D 2241/00
See application file for complete search history.

(56) References Cited

U.S. PATENT DOCUMENTS

| | | | |
|---|---|---|---|
| 3,111,436 | A | 11/1963 | McGavin |
| 3,330,705 | A | 7/1967 | Madrzyk et al. |
| 3,340,102 | A | 9/1967 | Kulin et al. |
| 3,516,874 | A | 6/1970 | Maker et al. |
| 3,907,614 | A | 9/1975 | Bramfitt et al. |
| 4,086,104 | A | 4/1978 | Kinoshita et al. |
| 4,146,411 | A | 3/1979 | Dewsnap et al. |
| 4,327,156 | A | 4/1982 | Dillon et al. |
| 4,486,248 | A | 12/1984 | Ackert et al. |
| 4,533,401 | A | 8/1985 | Yutori et al. |
| 4,744,836 | A | 5/1988 | Pfaffmann |
| 5,205,145 | A | 4/1993 | Ishino et al. |
| 5,358,578 | A | 10/1994 | Fischhauser |
| 5,554,233 | A | 9/1996 | Heitmann et al. |
| 5,989,647 | A | 11/1999 | Remy et al. |
| 6,270,594 | B1 | 8/2001 | Bodnar et al. |
| 6,296,805 | B1 | 10/2001 | Laurent et al. |
| 6,330,740 | B1 | 12/2001 | Krempels |
| 6,364,972 | B1 | 4/2002 | Bauer et al. |
| 6,564,604 | B2 | 5/2003 | Kefferstein et al. |
| 7,166,372 | B2 | 1/2007 | Bose et al. |
| 7,393,421 | B2 | 7/2008 | Yang |
| 7,677,070 | B2 | 3/2010 | Kobayashi |
| 7,703,312 | B2 | 4/2010 | Walter |
| 7,727,337 | B2 | 6/2010 | Sachdev et al. |
| 7,941,907 | B2 | 5/2011 | Yang et al. |
| 8,007,923 | B2 | 8/2011 | Sakakibara et al. |
| 8,141,230 | B2 | 3/2012 | Brodt et al. |
| 8,252,125 | B2 | 8/2012 | Giefers et al. |
| 8,440,323 | B2 | 5/2013 | Spehner et al. |
| 8,614,008 | B2 | 12/2013 | Canourgues et al. |
| 8,671,729 | B2 | 3/2014 | Verma et al. |
| 8,733,142 | B2 | 5/2014 | Spehner et al. |
| 8,778,261 | B2 | 7/2014 | Nakamura et al. |
| 8,888,934 | B2 | 11/2014 | Bian |
| 8,926,770 | B2 | 1/2015 | Kobayashi et al. |
| 8,932,416 | B2 | 1/2015 | Nakanishi et al. |
| 8,992,697 | B2 | 3/2015 | Matsuda et al. |
| 9,359,663 | B2 * | 6/2016 | Mizuta ..... C21D 6/001 |
| 9,475,113 | B2 | 10/2016 | Naitou et al. |
| 9,512,499 | B2 | 12/2016 | Tomokiyo et al. |
| 9,534,268 | B2 | 1/2017 | Ratte |
| 9,593,392 | B2 | 3/2017 | John et al. |
| 9,598,745 | B2 | 3/2017 | Hayashi et al. |
| 9,605,329 | B2 | 3/2017 | Nonaka et al. |
| 9,611,518 | B2 | 4/2017 | Naitou et al. |
| 9,617,624 | B2 | 4/2017 | Tanahashi et al. |
| 9,644,247 | B2 | 5/2017 | Matsuda et al. |
| 9,725,782 | B2 | 8/2017 | Nonaka et al. |
| 9,835,194 | B2 | 12/2017 | Chiba et al. |
| 9,840,751 | B2 | 12/2017 | Hayashi et al. |
| 9,850,554 | B2 | 12/2017 | Naitou et al. |
| 9,896,736 | B2 | 2/2018 | Tomokiyo et al. |
| 9,909,194 | B2 | 3/2018 | Puerta Velasquez et al. |
| 9,920,407 | B2 | 3/2018 | Nonaka et al. |
| 9,945,013 | B2 | 4/2018 | Nonaka et al. |
| 10,029,294 | B2 | 7/2018 | Yamano et al. |
| 10,030,280 | B2 | 7/2018 | Hayashi et al. |
| 10,072,324 | B2 | 9/2018 | Nonaka et al. |
| 10,260,121 | B2 | 4/2019 | Lu et al. |
| 10,385,415 | B2 | 8/2019 | Wang et al. |
| 10,619,223 | B2 | 4/2020 | Wang |
| 10,822,681 | B2 | 11/2020 | Schottler et al. |
| 2009/0155615 | A1 | 6/2009 | Chen et al. |
| 2009/0238715 | A1 | 9/2009 | Cho et al. |
| 2010/0026048 | A1 | 2/2010 | Vlot et al. |
| 2010/0028190 | A1 | 2/2010 | Wang |
| 2011/0139308 | A1 | 6/2011 | Peruzzi et al. |
| 2012/0211131 | A1 | 8/2012 | Altschuler et al. |
| 2012/0267012 | A1 | 10/2012 | Sohn et al. |
| 2013/0048161 | A1 | 2/2013 | Matsuda et al. |
| 2013/0180969 | A1 | 7/2013 | Cheng et al. |
| 2013/0186527 | A1 | 7/2013 | Bradley |
| 2013/0199679 | A1 | 8/2013 | Toji et al. |
| 2014/0020795 | A1 | 1/2014 | Schwinghammer et al. |
| 2014/0057121 | A1 | 2/2014 | Altschuler et al. |
| 2014/0065007 | A1 | 3/2014 | Naitou et al. |
| 2014/0212687 | A1 | 7/2014 | Vlot et al. |
| 2014/0261918 | A1 | 9/2014 | Jin et al. |
| 2014/0322559 | A1 | 10/2014 | Becker et al. |
| 2015/0020992 | A1 | 1/2015 | Schottler et al. |
| 2015/0024237 | A1 | 1/2015 | Tanahashi et al. |
| 2015/0082636 | A1 | 3/2015 | Gruneklee et al. |
| 2015/0090377 | A1 | 4/2015 | Murakami et al. |
| 2015/0114199 | A1 | 4/2015 | Shepard et al. |
| 2015/0203946 | A1 | 7/2015 | Hammer et al. |
| 2015/0225830 | A1 | 8/2015 | Nonaka et al. |
| 2016/0010168 | A1 | 1/2016 | Angles et al. |
| 2016/0017452 | A1 | 1/2016 | Puerta Velasquez et al. |
| 2016/0145707 | A1 | 5/2016 | Feuser et al. |
| 2016/0145731 | A1 | 5/2016 | Sachdev et al. |
| 2016/0147573 | A1 | 5/2016 | Shayesteh et al. |
| 2016/0215376 | A1 | 7/2016 | Luther et al. |
| 2016/0244855 | A1 | 8/2016 | Steinebach et al. |
| 2016/0319389 | A1 | 11/2016 | Hayashi et al. |
| 2017/0029913 | A1 | 2/2017 | Bae et al. |
| 2017/0051372 | A1 * | 2/2017 | Tomokiyo ..... C22C 38/02 |
| 2017/0314088 | A1 | 11/2017 | Wang |
| 2017/0314089 | A1 | 11/2017 | Wang |
| 2017/0321294 | A1 | 11/2017 | Arlazarov et al. |
| 2017/0342523 | A1 | 11/2017 | Wang et al. |
| 2018/0030567 | A1 | 2/2018 | Yi et al. |
| 2018/0216205 | A1 | 8/2018 | Wang et al. |
| 2018/0223385 | A1 | 8/2018 | Lu et al. |
| 2018/0237877 | A1 | 8/2018 | Wang et al. |
| 2018/0237892 | A1 * | 8/2018 | Schottler ..... C22C 38/38 |
| 2018/0251875 | A1 | 9/2018 | Pavlina |
| 2018/0312954 | A1 | 11/2018 | Yasui et al. |
| 2019/0127829 | A1 | 5/2019 | Santacreu et al. |
| 2020/0063232 | A1 * | 2/2020 | Lu ..... C22C 38/32 |
| 2020/0157665 | A1 | 5/2020 | Lu et al. |
| 2020/0190611 | A1 | 6/2020 | Lu et al. |
| 2020/0325552 | A1 | 10/2020 | Mraczek et al. |
| 2021/0002746 | A1 | 1/2021 | Lu et al. |
| 2021/0087661 | A1 | 3/2021 | Lu et al. |
| 2021/0189531 | A1 | 6/2021 | Lu et al. |
| 2021/0198760 | A1 | 7/2021 | Lu et al. |
| 2021/0222265 | A1 | 7/2021 | Lu et al. |
| 2021/0276065 | A1 | 9/2021 | Pang et al. |

FOREIGN PATENT DOCUMENTS

| | | | |
|---|---|---|---|
| CN | 101713046 | A | 5/2010 |
| CN | 102031456 | A | 4/2011 |
| CN | 102284523 | A | 12/2011 |
| CN | 102644028 | A | 8/2012 |
| CN | 102719783 | A | 10/2012 |
| CN | 102758133 | A | 10/2012 |
| CN | 102803519 | A | 11/2012 |
| CN | 102828109 | A | 12/2012 |
| CN | 102906291 | A | 1/2013 |
| CN | 102912219 | A | 2/2013 |
| CN | 103045950 | A | 4/2013 |
| CN | 103108964 | A | 5/2013 |

(56) References Cited

FOREIGN PATENT DOCUMENTS

| | | | | | |
|---|---|---|---|---|---|
| CN | 103547687 | A | | 1/2014 | |
| CN | 103556048 | A | | 2/2014 | |
| CN | 103620075 | A | | 3/2014 | |
| CN | 103842546 | A | | 6/2014 | |
| CN | 104160050 | A | | 11/2014 | |
| CN | 104160051 | A | | 11/2014 | |
| CN | 104195455 | A | | 12/2014 | |
| CN | 104379272 | A | | 2/2015 | |
| CN | 104846274 | A | | 8/2015 | |
| CN | 105026597 | A | | 11/2015 | |
| CN | 105483531 | A | | 4/2016 | |
| CN | 105648317 | A | | 6/2016 | |
| CN | 105658821 | A | | 6/2016 | |
| CN | 105671435 | A | | 6/2016 | |
| CN | 105734413 | A | | 7/2016 | |
| CN | 105886750 | A | | 8/2016 | |
| CN | 106086683 | A | | 11/2016 | |
| CN | 106399834 | A | | 2/2017 | |
| CN | 106521338 | A | | 3/2017 | |
| CN | 106906421 | A | | 6/2017 | |
| CN | 106929755 | A | | 7/2017 | |
| CN | 107002155 | A | | 8/2017 | |
| CN | 107127238 | A | | 9/2017 | |
| CN | 107338345 | A | | 11/2017 | |
| CN | 107338349 | A | | 11/2017 | |
| CN | 107354385 | A | | 11/2017 | |
| CN | 107815612 | A | | 3/2018 | |
| CN | 108359781 | A | | 8/2018 | |
| CN | 110050084 | A | | 7/2019 | |
| CN | 111542635 | A | | 8/2020 | |
| CN | 112176245 | A | | 1/2021 | |
| CN | 112513310 | A | | 3/2021 | |
| CN | 112534078 | A | | 3/2021 | |
| DE | 102009060388 | A1 | | 6/2011 | |
| DE | 102012104734 | A1 | | 12/2013 | |
| DE | 102015119417 | A1 | | 6/2016 | |
| DE | 102017108835 | A1 | | 11/2017 | |
| DE | 102017108837 | A1 | | 11/2017 | |
| DE | 102018101735 | A1 | | 8/2018 | |
| DE | 112016007444 | T5 | | 8/2019 | |
| EP | 1878811 | A1 | | 1/2008 | |
| EP | 1930450 | B1 | | 7/2011 | |
| EP | 2524970 | A1 | | 11/2012 | |
| EP | 3013988 | A1 | | 5/2016 | |
| EP | 3020842 | B1 | | 5/2016 | |
| EP | 2866147 | B1 | | 8/2016 | |
| EP | 2719788 | B1 | | 11/2016 | |
| EP | 3473735 | A1 | | 4/2019 | |
| JP | H0384378 | A | | 4/1991 | |
| JP | H09263886 | A | | 10/1997 | |
| JP | 2000178640 | A | | 6/2000 | |
| JP | 2003147486 | A | | 5/2003 | |
| JP | 2003201549 | A | | 7/2003 | |
| JP | 2005163123 | A | | 6/2005 | |
| JP | 2007321168 | A | | 12/2007 | |
| JP | 2008207279 | A | | 9/2008 | |
| JP | 2008261023 | A | | 10/2008 | |
| JP | 2010174302 | A | | 8/2010 | |
| JP | 2011016149 | A | | 1/2011 | |
| JP | 2011184768 | A | * | 9/2011 | |
| JP | 5015356 | B2 | | 8/2012 | |
| JP | 2013204089 | A | | 10/2013 | |
| JP | 2016125101 | A | | 7/2016 | |
| KR | 20110034452 | A | | 4/2011 | |
| KR | 20160057541 | A | | 5/2016 | |
| SU | 711126 | A1 | | 2/1980 | |
| WO | 2008102012 | A1 | | 8/2008 | |
| WO | 2012120020 | A1 | | 9/2012 | |
| WO | 2014024831 | A1 | | 2/2014 | |
| WO | 2014037627 | A1 | | 3/2014 | |
| WO | WO-2014128656 | A1 | * | 8/2014 | ..... C23C 2/26 |
| WO | 2015102051 | A1 | | 7/2015 | |
| WO | 2016079565 | A1 | | 5/2016 | |
| WO | 2016095664 | A1 | | 6/2016 | |
| WO | 2016106621 | A1 | | 7/2016 | |
| WO | 2018107446 | A1 | | 6/2018 | |
| WO | WO-2018107446 | A1 | * | 6/2018 | ..... C21D 1/74 |
| WO | 2019085855 | A1 | | 5/2019 | |
| WO | 2019127240 | A1 | | 7/2019 | |
| WO | 2019222950 | A1 | | 11/2019 | |
| WO | 2019241902 | A1 | | 12/2019 | |

OTHER PUBLICATIONS

"Dip, Barrier, and Chemical Conversion Coating," Metals Handbook Desk Edition, ASM International, 1998, p. 1154-1165 (Year: 1998).

"Process to improve oxidation resistance of press hardening steels," Research Disclosure, Database No. 641010 (Published online: Jul. 28, 2017), 2 pages.

Altan, Taylan, "Hot-stamping boron-alloyed steels for automotive parts—Part I—Press Technology Tech Cell"; http://www.thefabricator.com/article/presstechnology/hot-stamping-boron-alloyed-steels-for-automotive-parts; Feb. 13, 2007; 3 pages.

Altan, Taylan, "Hot-stamping boron-alloyed steels for automotive parts—Part II—Press Technology Tech Cell"; http://www.thefabricator.com/article/presstechnology/hot-stamping-boron-alloyed-steels-for-automotive-parts-part-ii; Jan. 18, 2007; 2 pages.

Altan, Taylan, "Hot-stamping boron-alloyed steels for automotive parts—Part III—Press Technology Tech Cell"; http://www.thefabricator.com/article/presstechnology/hot-stamping-boron-alloyed-steels-for-automotive-parts-part-iii; Feb. 13, 2007; 2 pages.

Diekman, F. "Cold and Cryogenic Treatment of Steel," ASM Handbook, vol. 4A, Steel Heat Treating Fundamentals and Processes, pp. 382-386.

Dossett, John L. et al., "Practical Heat Treating," Second Edition (ASM International, 2006), pp. 7, 269. ISBN 1615031103 (Year: 2006).

Ghanbari, Zahra N. et al., "Zinc Coated Sheet Steel for Press Hardening (Master's Thesis)" Submitted to the Faculty and the Board of Trustees of the Colorado School of Mines, Fall 2014.

Grajcar, Adam et al.; "Phase Equilibrium and Austenite Decomposition in Advanced High-Strength Medium-Mn Bainitic Steels"; www.mdpi.com/journal/metals; Oct. 20, 2016; 14 pages.

Karbasian, H. et al.; "A review on hot stamping"; Journal of Materials Processing Technology 210; Jul. 19, 2010; pp. 2103-2118.

Kurz, Thomas et al.; "Zinc Coated Press-Hardening Steel: Challenges and Solutions"; Voestalpine (Published Apr. 14, 2015), 12 pages.

Leonard, R. "Continuous Hot Dip Coatings," Corrosion: Fundamentals, Testing, and Protection, vol. 13A, ASM Handbook, ASM International, 2003, p. 786-796 (Year: 2003).

Liu, Hong-Sheng et al., "Hot Formation Quality of High Strength Steel BR1500HS for Hot Stamping without Cooling System," Trans. Nonferrous Met. Soc. China (2012), vol. 22, pp. s542-s547.

Merklein, Marion et al., "A review on tailored blanks—Production, applications and evaluation," Journal of Materials Processing Technology (2014) 214, pp. 151-164; DOI: 10.1016/j.matprotec.2013.08.015 (Published online Sep. 6, 2013).

Mori, K. et al., "Warm and Hot Stamping of Ultra High Tensile Strength Steel Sheets Using Resistance Heating," CIRP Annals Manufacturing Technology (2005), vol. 54 (1), pp. 209-212.

Naderi, Malek et al., "Semi-hot Stamping as an Improved Process of Hot Stamping," J. Mater. Sci. Technol. (2011), vol. 27 (4) pp. 369-376.

Yi, H.L., "Dual-Phase Hot-Press Forming Alloy," Materials Science and Engineering A, 527 (2010). pp. 4870-4874.

Lu, Qi et al., International Application No. PCT/CN2017/119484 filed Dec. 28, 2017 entitled "Steel for Hot Stamping With Enhanced Oxidation Resistance," 39 pages.

Lu, Qi et al., International Application No. PCT/CN2018/088122 filed May 24, 2018 entitled "A Method for Improving Both Strength and Ductility of a Press-Hardening Steel," 32 pages.

Pang, Jiachen et al., International Application No. PCT/CN2018/091751 filed Jun. 19, 2018 entitled "Low Density Press-Hardening Steel Having Enhanced Mechanical Properties," 44 pages.

(56) References Cited

OTHER PUBLICATIONS

International Search Report and Written Opinion for International Application No. PCT/CN2014/095753 dated Oct. 8, 2015; 8 pages (ISA/CN).
International Search Report and Written Opinion for International Application No. PCT/CN2016/110241 dated Sep. 25, 2017, 12 pages (ISA/CN).
International Search Report and Written Opinion for International Application No. PCT/CN2017/119484 dated Sep. 12, 2018, 9 pages (ISA/CN).
International Search Report and Written Opinion for International Application No. PCT/CN2018/091751 dated Mar. 15, 2019, 9 pages (ISA/CN).
First Office Action for German Patent Application No. 102015119417.1 dated Feb. 16, 2017; 5 pages.
First Office Action for Chinese Patent Application No. 201511036174.4 dated Feb. 28, 2017 with English language machine translation, 18 pages.
Second Office Action for Chinese Patent Application No. 201511036174.4 dated Nov. 16, 2017 with English language machine translation; 15 pages.
First Office Action for Chinese Patent Application No. 201710222523.4 dated Apr. 27, 2018 and correspondence from China Patent Agent (H.K.) Ltd summarizing Office Action; 9 pages.
First Office Action for Chinese Patent Application No. 201710224443.2 dated May 3, 2018 and correspondence from China Patent Agent (H.K.) Ltd summarizing Office Action; 9 pages.
Third Office Action for Chinese Patent Application No. 201511036174.4 dated Jul. 2, 2018 with English language machine translation; 26 pages.
First Office Action for German Patent Application No. 102017108835.0 dated Jul. 24, 2018 and correspondence dated Aug. 8, 2018 from Manitz Finsterwald Patentanwälte PartmbB summarizing contents; 6 pages.
First Office Action for German Patent Application No. 102017108837.7 dated Jul. 25, 2018 and correspondence from dated Aug. 8, 2018 Manitz Finsterwald Patentanwälte PartmbB summarizing contents; 6 pages.
First Office Action for Chinese Patent Application No. 201810061046.2 dated Mar. 1, 2019 with English language machine translation; 18 pages.
First Office Action for German Patent Application No. 102018101735.9 dated May 3, 2019 with correspondence from Manitz Finsterwald Patentanwälte PartmbB summarizing contents, 6 pages.
Anonymous, "Steel Definitions, Today's AHSS for Automotive" WorldAutoSteel, [retrieved on Nov. 27, 2019]. Retrieved from the Internet: <URL: https://www.worldautosteel.org/steel-basics/automotive-steel-definitions/ <https://protect-us.mimecast.com/s/qVeXCADQNWCNqxzXcGLKQI>, 5 pages.
Anonymous, "Transformation-Induced Plasticity (TRIP) Steel" WorldAutoSteel, [retrieved on Nov. 27, 2019], Retrieved from the Internet: <URL:https://www.woridautosteel.org/steel-basics/steel-types/transformation-induced-plasticity-trip-steel/>, 5 pages.
Anonymous, "TRIP steel" Wikipedia, [retrieved on Nov. 27, 2019], retrieved from the Internet: <URL: https://en.wikipedia.org/wiki/TRIP_steel>, 3 pages.
First Office Action for Chinese Patent Application No. 201680091625.0 dated Jul. 8, 2020 with English language machine translation, 11 pages.
International Search Report and Written Opinion for International Application No. PCT/CN2018/088122 dated Feb. 26, 2019, 8 pages (ISA/CN).
Cao et al.; Oxidation Kinetics and Spallation Model of Oxide Scale during Cooling Process of Low Carbon Microalloyed Steel; Sep. 24, 2016; de Gruyter; High Temperature Materials and Processes vol. 36 Issue 9, p. 1-10 (Year: 2016).
Lu, Qi et al., U.S. Appl. No. 17/153,848, filed Jan. 20, 2021 entitled "Press Hardening Steel With High Oxidation Resistance," 37 pages.
First Office Action for Chinese Patent Application No. 202010626153.2 dated Jun. 16, 2021 with correspondence iated Jun. 23, 2021 from China Patent Agent (H.K.) Ltd summarizing contents, 10 pages.
Khanna, A.S., "Introduction to High Temperature Oxidation and Corrosion." ASM International, Materials Park, OH, p. 123 (2002).
First Office Action for Chinese Patent Application No. 201780098042.5 dated May 26, 2021 with English language machine translation, 20 pages.
Wang, Min et al., "Inverse evaluation of equivalent contact heat transfer coefficient in hot stamping of boron steel." The International Journal of Advanced Manufacturing Technology, vol. 87, pp. 2925-2932 (2016).
Yi et al., Dual-phase hot press forming alloy, 2010, Elsevier, Materials Science and Engineering A, p. 4870-4874 (Year: 2010).
First Office Action for Chinese Patent Application No. 201880095869.5 dated Sep. 15, 2021 with correspondence dated Sep. 17, 2021 from China Patent Agent (H.K.) Ltd. summarizing contents, 9 pages.
Second Office Action for Chinese Patent Application No. 201780098042.5 dated Nov. 17, 2021, with correspondence dated Nov. 22, 2021, from China Patent Agent (H.K.) Ltd summarizing contents; 9 pages.
First Office Action for Chinese Patent Application No. 201880096658.3 dated Nov. 18, 2021, with correspondence dated Nov. 22, 2021, from China Patent Agent (H.K.) Ltd summarizing contents; 8 pages.
Second Office Action for Chinese Patent Application No. 2020106261153.2 dated Mar. 9, 2022, with correspondence dated Mar. 14, 2022, from China Patent Agent (H.K.) Ltd summarizing contents; 12 pages.

* cited by examiner

PRESS HARDENED STEEL WITH SURFACE LAYERED HOMOGENOUS OXIDE AFTER HOT FORMING

INTRODUCTION

This section provides background information related to the present disclosure which is not necessarily prior art.

Press-hardened steel (PHS), also referred to as "hot-stamped steel" or "hot-formed steel," is one of the strongest steels used for automotive body structural applications, having tensile strength properties of about 1,500 mega-Pascal (MPa). Such steel has desirable properties, including forming steel components with significant increases in strength-to-weight ratios. PHS components have become ever more prevalent in various industries and applications, including general manufacturing, construction equipment, automotive or other transportation industries, home or industrial structures, and the like. For example, when manufacturing vehicles, especially automobiles, continual improvement in fuel efficiency and performance is desirable; therefore, PHS components have been increasingly used. PHS components are often used for forming load-bearing components, like door beams, which usually require high strength materials. Thus, the finished state of these steels are designed to have high strength and enough ductility to resist external forces, such as, for example, resisting intrusion into the passenger compartment without fracturing so as to provide protection to the occupants. Moreover, galvanized PHS components may provide cathodic protection.

Many PHS processes involve austenitization of a sheet steel blank in a furnace, immediately followed by pressing and quenching of the sheet in dies. Austenitization is typically conducted in the range of about 880° C. to 950° C. PHS processes may be indirect or direct. In the direct method, the PHS component is formed and pressed simultaneously between dies, which quenches the steel. In the indirect method, the PHS component is cold-formed to an intermediate partial shape before austenitization and the subsequent pressing and quenching steps. The quenching of the PHS component hardens the component by transforming the microstructure from austenite to martensite. An oxide layer often forms on the surface of the component during the transfer from the furnace to the dies when the component is fabricated from uncoated steel. Therefore, after quenching, the oxide must be removed from the PHS component and the dies. The oxide is typically removed, i.e., descaled, by shot blasting.

The PHS component may be made from bare or coated alloys. Coating the PHS component with, e.g., zinc or Al—Si, provides a protective layer to the underlying steel component. Zinc coatings, for example, offer cathodic protection; the coating acts as a sacrificial layer and corrodes instead of the steel component, even where the steel is exposed. Whereas zinc-coated PHS generates oxides on PHS components' surfaces, which are removed by shot blasting, Al—Si coated PHS does not require shot blasting. Accordingly, alloy compositions that do not require coatings or other treatments are desired.

SUMMARY

This section provides a general summary of the disclosure, and is not a comprehensive disclosure of its full scope or all of its features.

In various aspects, the current technology provides a press-hardened steel having: an alloy matrix including carbon (C) at a concentration of greater than or equal to about 0.01 wt. % to less than or equal to about 0.35 wt. %, chromium (Cr) at a concentration of greater than or equal to about 1 wt. % to less than or equal to about 9 wt. %, silicon (Si) at a concentration of greater than or equal to about 0.5 wt. % to less than or equal to about 2 wt. %, and a balance of iron (Fe), the alloy matrix being greater than or equal to about 95 vol. % martensite; a first layer disposed directly on the alloy matrix, the first layer being continuous, having a thickness of greater than or equal to about 0.01 μm to less than or equal to about 10 μm, and including an oxide enriched with Cr and Si; and a second layer disposed directly on the first layer, the second layer including an oxide enriched with Fe.

In one aspect, the alloy matrix further includes manganese (Mn) at a concentration of greater than or equal to about 0.01 wt. % to less than or equal to about 3 wt. %, molybdenum (Mo) at a concentration of greater than or equal to about 0.01 wt. % to less than or equal to about 0.8 wt. %, niobium (Nb) at a concentration of greater than or equal to about 0.01 wt. % to less than or equal to about 0.3 wt. %, vanadium (V) at a concentration of greater than or equal to about 0.01 wt. % to less than or equal to about 0.3 wt. %, or a mixture thereof.

In one aspect, the alloy matrix further includes boron (B) at a concentration of less than or equal to about 0.005 wt. %, and nitrogen (N) at a concentration of less than or equal to about 0.01 wt. %.

In one aspect, the alloy matrix includes the Cr at a concentration of greater than or equal to about 2 wt. % to less than or equal to about 3 wt. % and the Si at a concentration of greater than or equal to about 0.6 wt. % to less than or equal to about 1.8 wt. %.

In one aspect, the oxide of the first layer is enriched with the Cr at a concentration of at greater than or equal to about 1 wt. % to less than or equal to about 30 wt. % and the Si at a concentration of at greater than or equal to about 1 wt. % to less than or equal to about 30 wt. %.

In one aspect, the first layer has a thickness of greater than or equal to about 0.01 μm to less than or equal to about 10 μm.

In one aspect, the first layer is formed from the Cr and the Si of the alloy matrix, and the press-hardened steel is free of any layer that is not derived from the alloy matrix.

In one aspect, the second layer is continuous and homogenous, and has a thickness of greater than or equal to about 0.01 μm to less than or equal to about 30 μm.

In one aspect, the oxide enriched with the Fe includes FeO, $Fe_2O_3$, $Fe_3O_4$, or a combination thereof.

In one aspect, the press-hardened steel is in the form of a vehicle part.

In various aspects, the current technology also provides a press-hardened steel having: an alloy matrix including carbon (C) at a concentration of greater than or equal to about 0.01 wt. % to less than or equal to about 0.35 wt. %, chromium (Cr) at a concentration of greater than or equal to about 1 wt. % to less than or equal to about 9 wt. %, silicon (Si) at a concentration of greater than or equal to about 0.5 wt. % to less than or equal to about 2 wt. %, and a balance of iron (Fe), the alloy matrix being greater than or equal to about 95 vol. % martensite; a first layer disposed directly on the alloy matrix, the first layer being continuous, having a thickness of greater than or equal to about 0.01 μm to less than or equal to about 10 μm, and including an oxide enriched with Cr and Si; and a second layer disposed directly on the first layer, the second layer being continuous and homogenous, having a thickness of less than or equal to about 30 μm, and including FeO, $Fe_2O_3$, $Fe_3O_4$, or a combination thereof, wherein the first layer and the second layer are derived from the alloy matrix during press hardening, and wherein the press-hardened steel is free of any layer or coating that is not derived from the alloy matrix.

In one aspect, the second layer has a thickness of greater than or equal to about 0.01 μm to less than or equal to about 30 μm.

In one aspect, the press-hardened steel has an ultimate tensile strength (UTS) of greater than or equal to about 500 MPa.

In various aspects, the current technology yet further provides a method of fabricating a press-hardened steel component, the method including: cutting a blank from a steel alloy, the steel alloy being uncoated and including carbon (C) at a concentration of greater than or equal to about 0.01 wt. % to less than or equal to about 0.35 wt. %, chromium (Cr) at a concentration of greater than or equal to about 1 wt. % to less than or equal to about 9 wt. %, silicon (Si) at a concentration of greater than or equal to about 0.5 wt. % to less than or equal to about 2 wt. %, and a balance of iron (Fe); heating the blank to a temperature greater than or equal to about 880° C. to less than or equal to about 950° C. to fully austenitize the steel alloy; stamping the blank in a die to form a structure having a predetermined shape from the blank; and quenching the structure to a temperature less than or equal to about a martensite finish ($M_f$) temperature of the steel alloy and greater than or equal to about room temperature to form the press-hardened steel component, wherein the press-hardened steel component includes: an alloy matrix including the C, Cr, Si, and Fe of the steel alloy; a first layer disposed directly on the alloy matrix, the first layer being continuous, having a thickness of greater than or equal to about 0.01 μm to less than or equal to about 10 μm, and including an oxide enriched with portions of the Cr and of the Si of the steel alloy; and a second layer disposed directly on the first layer, the second layer being continuous and homogenous, having a thickness of greater than or equal to about 0.01 μm to less than or equal to about 30 μm, and including an oxide enriched with a portion of the Fe of the steel alloy, wherein the method is free of a descaling step, and wherein the press-hardened steel component is free of a layer of zinc (Zn) or an aluminum-silicon (Al—Si) coating.

In one aspect, the quenching including decreasing the temperature of the structure at a rate of greater than or equal to about 15° C./s.

In one aspect, the oxide enriched with the portion of the Fe of the steel alloy of the second layer includes FeO, $Fe_2O_3$, $Fe_3O_4$, or a combination thereof.

In one aspect, the heating, the stamping, and the quenching are performed in an anaerobic atmosphere.

In one aspect, the alloy matrix includes greater than or equal to about 95 vol. % martensite.

In one aspect, the method is free of a secondary heat treatment after the quenching.

In one aspect, the press-hardened steel component is an automobile part selected from the group consisting of a pillar, a bumper, a roof rail, a rocker rail, a rocker, a control arm, a beam, a tunnel, a beam, a step, a subframe member, and a reinforcement panel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 5A:
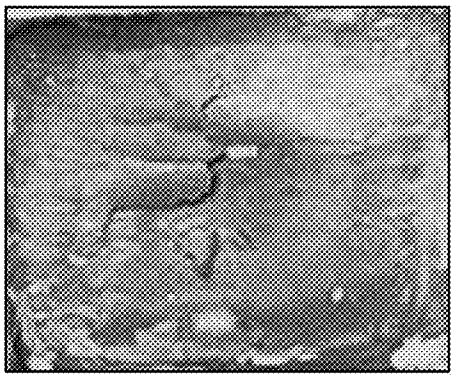
Figure 5C:
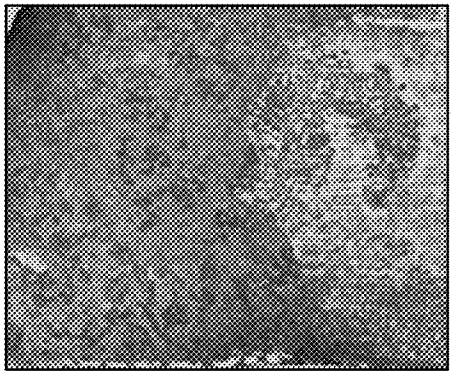
Figure 5E:
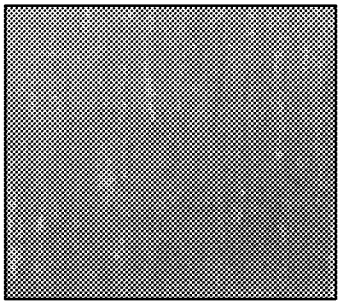
Figure 5B:
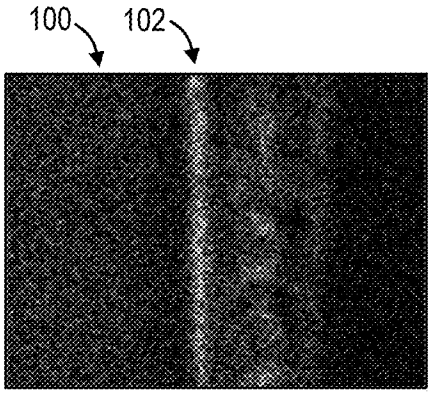
Figure 5D:
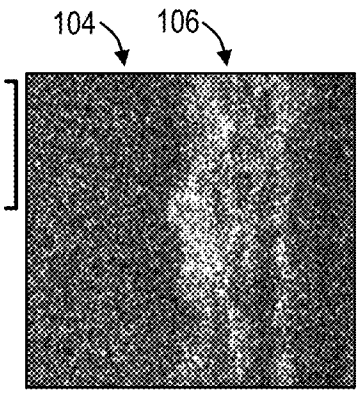
Figure 5F:
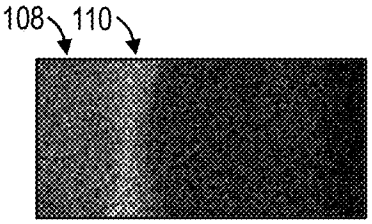
Figure 5G:
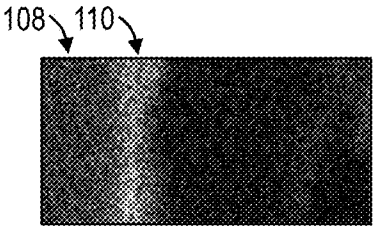

FIGS. 5A-5G show surface images and Scanning Electron Microscopy-Energy Dispersive X-Ray Spectroscopy (SEM-EDS) maps of press-hardened steel cross sections. FIG. 5A is a surface image of a 3Cr0Si press-hardened steel, and FIG. 5B is a Cr SEM-EDS map of its cross section. FIG. 5C is a surface image of a 0Cr1.8Si press-hardened steel, and FIG. 5D is a Si SEM-EDS map of its cross section. FIG. 5E is a surface image of a 3Cr1.5Si press-hardened steel prepared in accordance with various aspects of the current technology, and FIGS. 5F and 5G are Cr and Si SEM-EDS maps of its cross section, respectively. The scale bars in FIGS. 5B and 5D are 10 μm and 5 μm, respectively.

Figure 6:
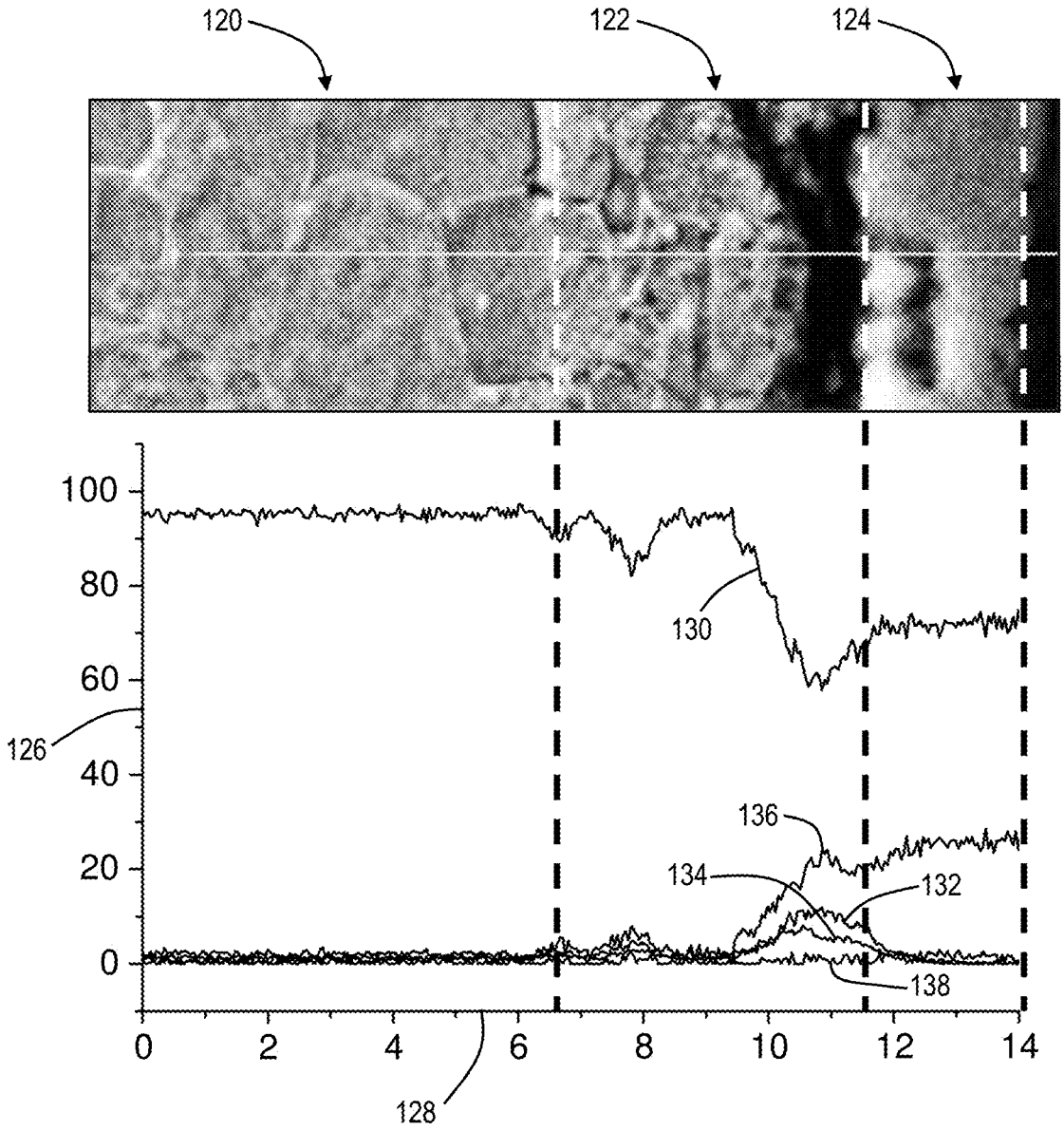

FIG. 6 shows a cross-sectional micrograph of a 3Cr1.5Si press-hardened steel prepared in accordance with various aspects of the current technology and a corresponding graph showing elemental concentration versus distance.

Figure 7A:
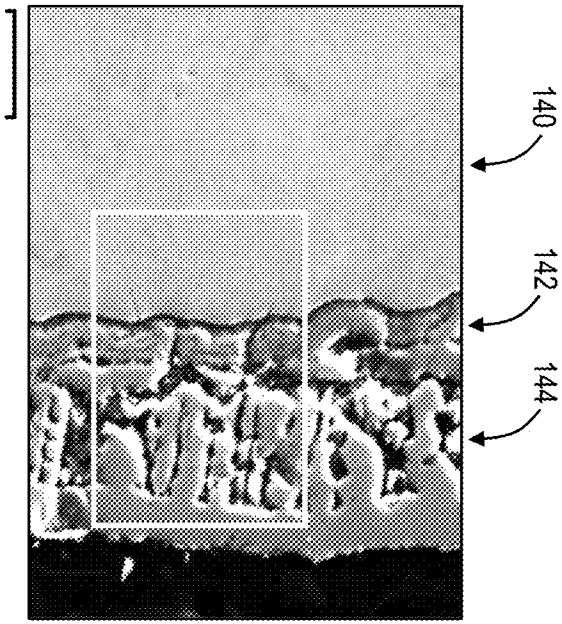
Figure 7B:
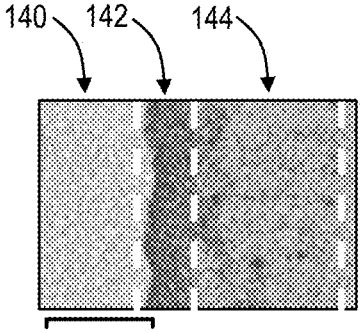
Figure 7C:
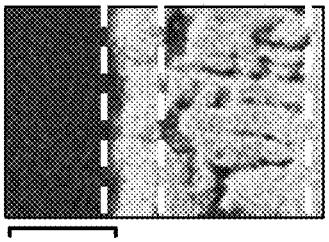
Figure 7D:
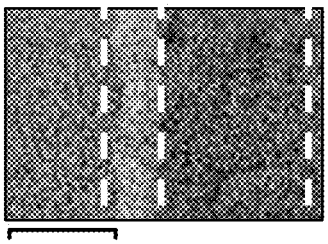
Figure 7E:
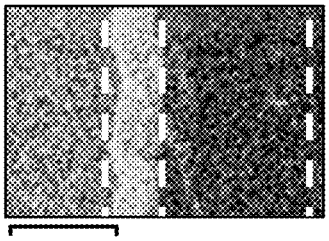

FIGS. 7A-7E show a surface micrograph and cross-sectional SEM-EDS maps of a 3Cr0.6Si press-hardened steel prepared in accordance with various aspects of the current technology. FIG. 7A is the surface micrograph, and FIGS. 7B-7E are cross-sectional Fe, O, Si, and Cr SEM-EDS maps, respectively.

Figure 8:
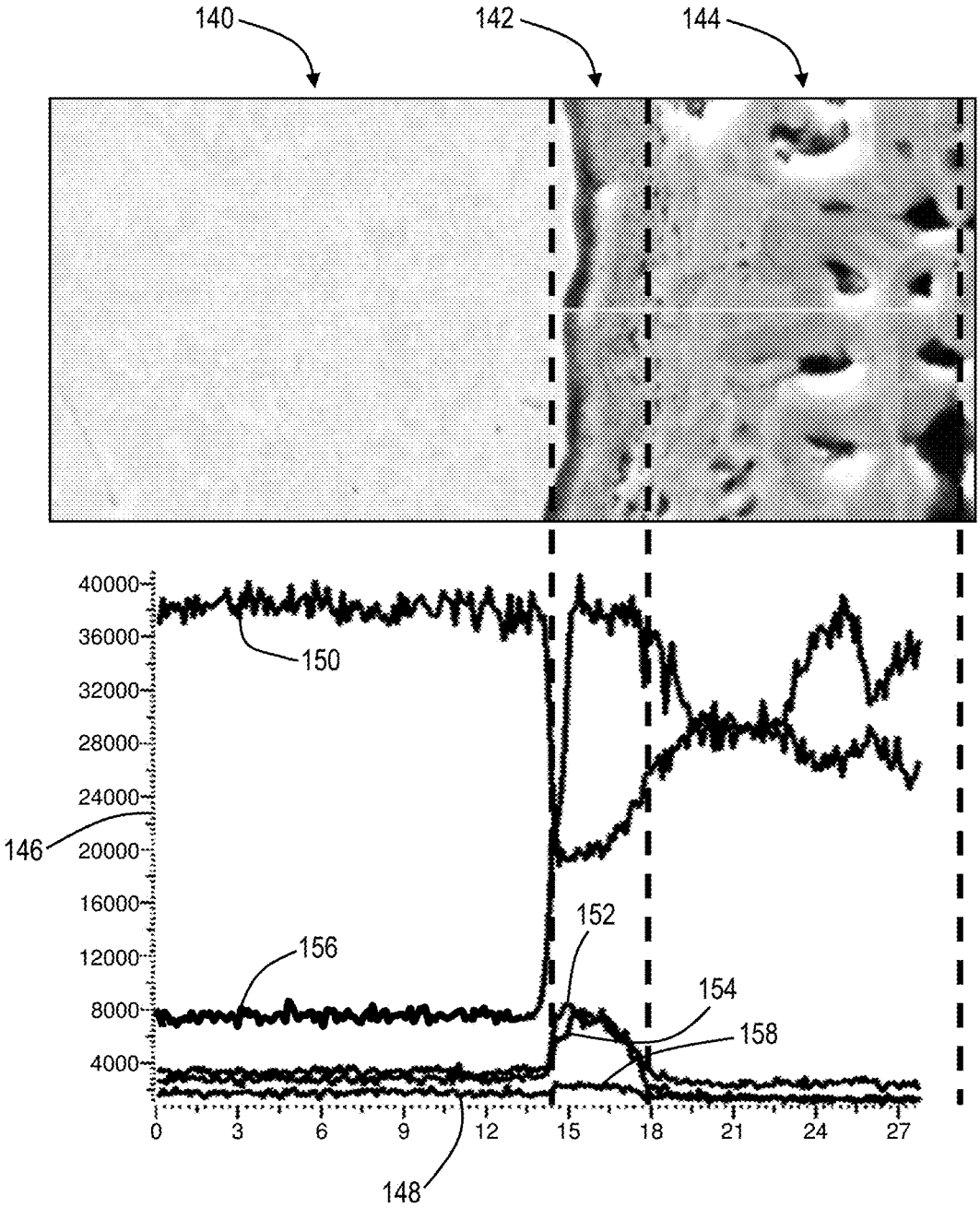

FIG. 8 shows a cross-sectional micrograph of a 3Cr0.6Si press-hardened steel prepared in accordance with various aspects of the current technology and a corresponding graph showing elemental concentration versus distance.

Figure 9A:
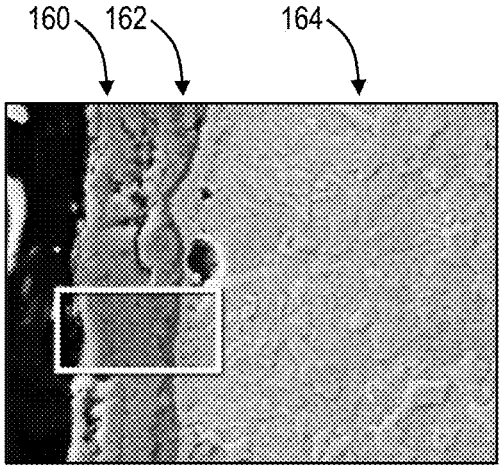
Figure 9B:
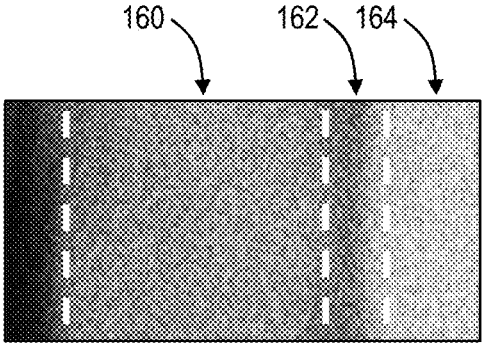
Figure 9C:
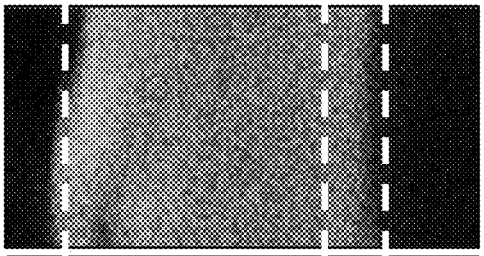
Figure 9D:
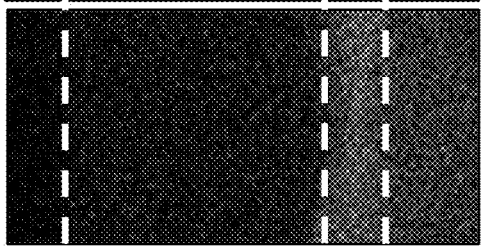
Figure 9E:
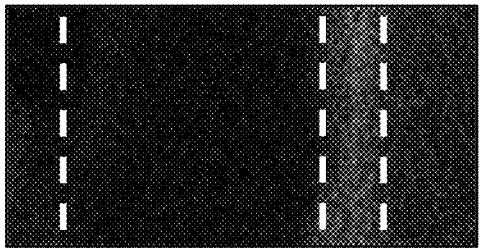

FIGS. 9A-9E show a surface micrograph and cross-sectional SEM-EDS maps of a 2Cr1.5Si press-hardened steel prepared in accordance with various aspects of the current technology. FIG. 9A is the surface micrograph, and FIGS. 9B-9E are cross-sectional Fe, O, Si, and Cr SEM-EDS maps, respectively.

Figure 10A:
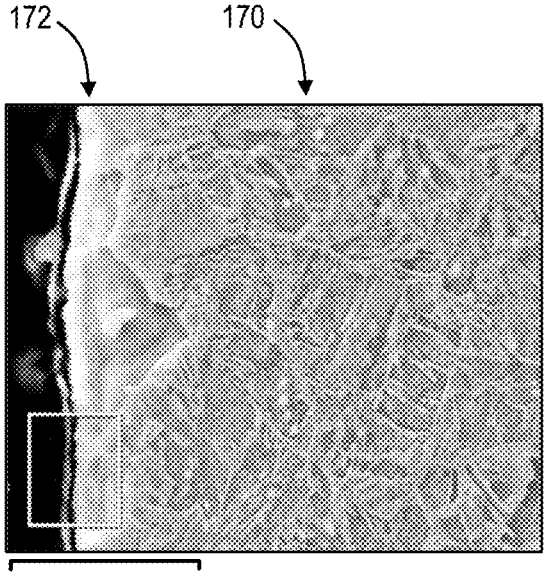
Figure 10B:
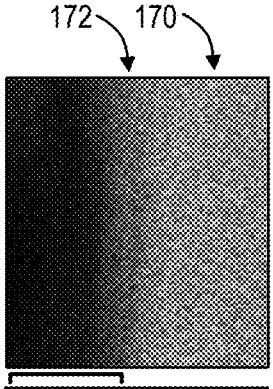
Figure 10C:
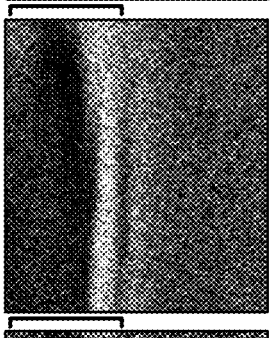
Figure 10D:
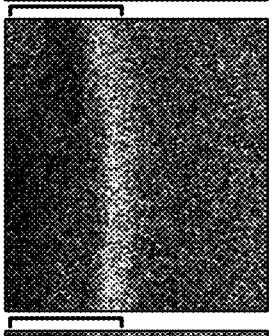
Figure 10E:
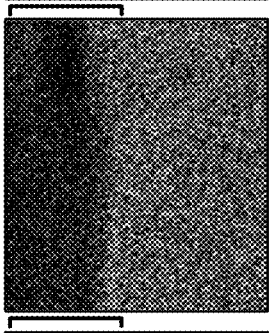
Figure 10F:
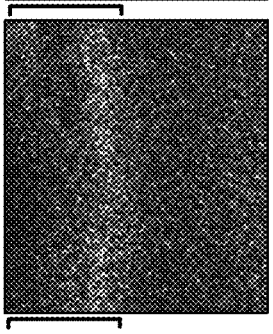

FIGS. 10A-10F show a surface micrograph and cross-sectional SEM-EDS maps of a 3Cr1.5Si press-hardened steel prepared in accordance with various aspects of the current technology. FIG. 10A is the surface micrograph, and FIGS. 10B-10F are cross-sectional Fe, O, Cr, Si, and Mn SEM-EDS maps, respectively.

Figure 11:
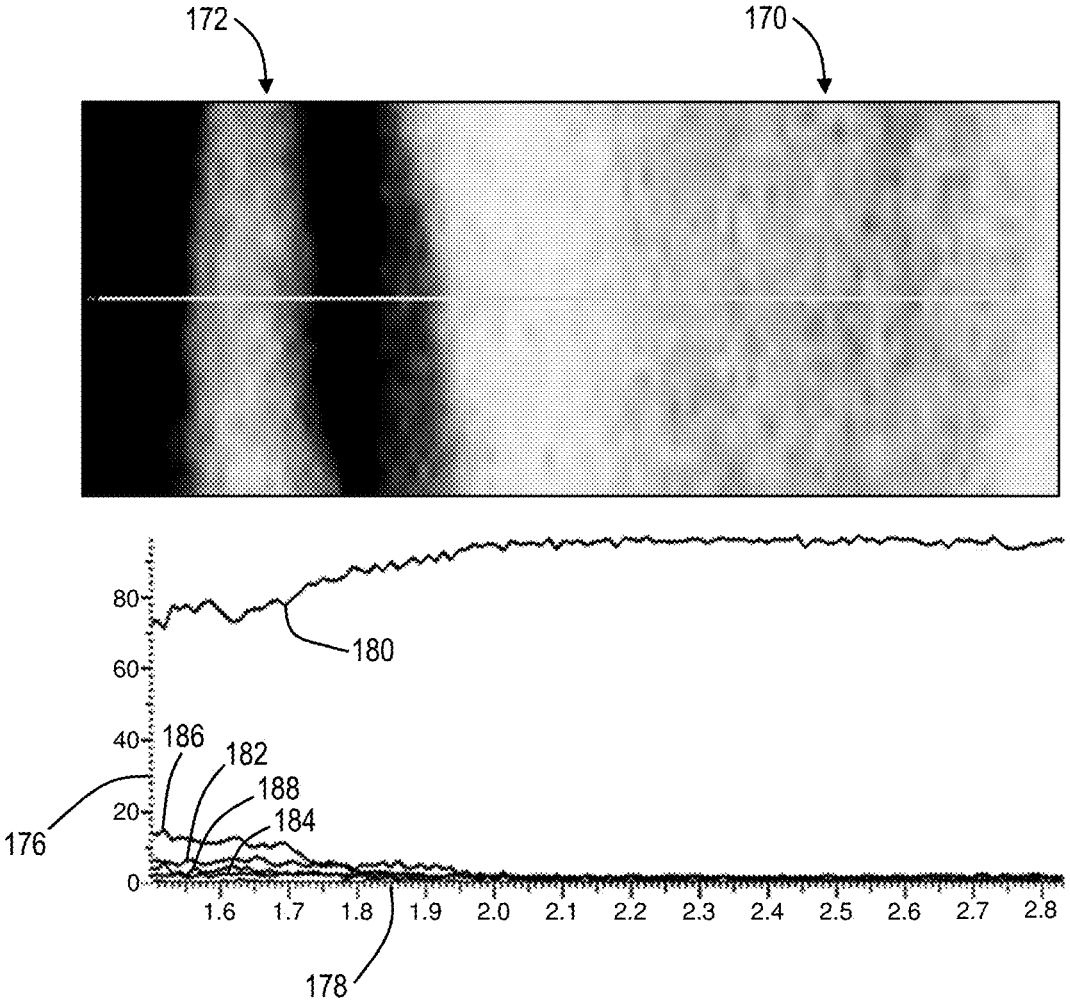

FIG. 11 shows a cross-sectional micrograph of a 3Cr1.5Si press-hardened steel prepared in accordance with various aspects of the current technology and a corresponding graph showing elemental concentration versus distance.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

As discussed above, there are certain disadvantages associated with descaling uncoated press-hardened steels and coating press-hardened steels. Accordingly, the current technology provides a steel alloy that is configured to be hot stamped into a press-hardened component having a predetermined shape without coatings and without a need to perform descaling.

The steel alloy is in the form of a coil or sheet and comprises carbon (C), chromium (Cr), silicon (Si), and iron (Fe). During a hot stamping process, portions of the Cr and Si combine with atmospheric oxygen to form a first layer comprising an oxide enriched with the portions of the Cr and Si. As discussed in more detail below, when there is sufficient oxygen in the atmosphere, a portion of the Fe combines with atmospheric oxygen to form a second layer comprising an oxide enriched with Fe. As used in regard to the first and second layers, the terms "first" and "second" distinguish the layers structurally from each other and do not relate to an order of formation during hot stamping. Therefore, when the first and second layers are both formed during hot stamping, the first layer may be formed prior to the formation of the second layer, the second layer may be formed prior to the formation of the first layer, or the first and second layers may be formed simultaneously. The first and second layers prevent, inhibit, or minimize further oxidation so that descaling steps, such as shot blasting or sand blasting, are not required.

The C is present in the steel alloy at a concentration of greater than or equal to about 0.01 wt. % to less than or equal to about 0.35 wt. % and subranges thereof. In various embodiments, the steel alloy comprises C at a concentration of about 0.01 wt. %, about 0.02 wt. %, about 0.04 wt. %, about 0.06 wt. %, about 0.08 wt. %, about 0.1 wt. %, about 0.12 wt. %, about 0.14 wt. %, about 0.16 wt. %, about 0.18 wt. %, about 0.2 wt. %, about 0.22 wt. %, about 0.24 wt. %, about 0.26 wt. %, about 0.28 wt. %, about 0.3 wt. %, 0.32 wt. %, about 0.34 wt. %, or about 0.35 wt. %.

The Cr is present in the steel alloy at a concentration of greater than or equal to about 1 wt. % to less than or equal to about 9 wt. %, greater than or equal to about 1 wt. % to less than or equal to about 6 wt. %, greater than or equal to about 1 wt. % to less than or equal to about 4 wt. %, or greater than or equal to about 1 wt. % to less than or equal to about 3 wt. %. In various embodiments, the steel alloy comprises Cr at a concentration of about 1 wt. %, about 1.2 wt. %, about 1.4 wt. %, about 1.5 wt. %, about 1.6 wt. %, about 1.8 wt. %, about 2 wt. %, about 2.2 wt. %, about 2.4 wt. %, about 2.5 wt. %, about 2.6 wt. %, about 2.8 wt. %, about 3 wt. %, about 3.2 wt. %, about 3.4 wt. %, about 3.5 wt. %, about 3.6 wt. %, about 3.8 wt. %, about 4 wt. %, about 4.2 wt. %, about 4.4 wt. %, about 4.5 wt. %, about 4.6 wt. %, about 4.8 wt. %, about 5 wt. %, about 5.2 wt. %, about 5.4 wt. %, about 5.5 wt. %, about 5.6 wt. %, about 5.8 wt. %, about 6 wt. %, about 6.2 wt. %, about 6.4 wt. %, about 6.5 wt. %, about 6.6 wt. %, about 6.8 wt. %, about 7 wt. %, about 7.2 wt. %, about 7.4 wt. %, about 7.5 wt. %, about 7.6 wt. %, about 7.8 wt. %, about 8 wt. %, about 8.2 wt. %, about 8.4 wt. %, about 8.5 wt. %, about 8.6 wt. %, about 8.8 wt. %, or about 9 wt. %.

The Si is present in the steel alloy at a concentration of greater than or equal to about 0.5 wt. % to less than or equal to about 2 wt. % or greater than or equal to about 0.6 wt. % to less than or equal to about 1.8 wt. %. In various embodiments, the steel alloy comprises Si at a concentration of about 0.5 wt. %, about 0.6 wt. %, about 0.7 wt. %, about 0.8 wt. %, about 0.9 wt. %, about 1 wt. %, about 1.1 wt. %, about 1.2 wt. %, about 1.3 wt. %, about 1.4 wt. %, about 1.5 wt. %, about 1.6 wt. %, about 1.7 wt. %, about 1.8 wt. %, about 1.9 wt. %, or about 2 wt. %.

The Fe makes up the balance of the steel alloy.

In various embodiments, the steel alloy further comprises manganese (Mn) at a concentration of greater than or equal to about 0 wt. % to less than or equal to about 3 wt. %, greater than or equal to about 0.2 wt. % to less than or equal to about 3 wt. %, greater than or equal to about 0.25 wt. % to less than or equal to about 2.5 wt. %, greater than or equal to about 0.5 wt. % to less than or equal to about 2 wt. %, greater than or equal to about 0.75 wt. % to less than or equal to about 1.5 wt. %, or greater than or equal to about 1 wt. % to less than or equal to about 1.5 wt. %. In some embodiments, the steel alloy is substantially free of Mn. As used herein, "substantially free" refers to trace component levels, such as levels of less than or equal to about 1.5%, less than or equal to about 1%, less than or equal to about 0.5%, or levels that are not detectable. In various embodiments, the steel alloy is substantially free of Mn or comprises Mn at a concentration of less than or equal to about 3 wt. %, less than or equal to about 2.5 wt. %, less than or equal to about 2 wt. %, less than or equal to about 1.5 wt. %, less than or equal to about 1 wt. %, or less than or equal to about 0.5 wt. %, such as at a concentration of about 3 wt. %, about 2.8 wt. %, about 2.6 wt. %, about 2.4 wt. %, about 2.2 wt. %, about 2 wt. %, about 1.8 wt. %, about 1.6 wt. %, about 1.4 wt. %, about 1.2 wt. %, about 1 wt. %, about 0.8 wt. %, about 0.6 wt. %, about 0.4 wt. %, about 0.2 wt. %, or lower.

In various embodiments, the steel alloy further comprises nitrogen (N) at a concentration of greater than or equal to about 0 wt. % to less than or equal to about 0.01 wt. % or greater than or equal to about 0.0001 wt. % to less than or equal to about 0.01 wt. %. For example, in various embodiments, the steel alloy is substantially free of N or comprises N at a concentration of less than or equal to about 0.01 wt. %, less than or equal to 0.009 wt. %, less than or equal to 0.008 wt. %, less than or equal to 0.007 wt. %, less than or equal to 0.006 wt. %, less than or equal to 0.005 wt. %, less than or equal to 0.004 wt. %, less than or equal to 0.003 wt. %, less than or equal to 0.002 wt. %, or less than or equal to 0.001 wt. %, such as at a concentration of about 0.01 wt. %, about 0.009 wt. %, about 0.008 wt. %, about 0.007 wt. %, about 0.006 wt. %, about 0.005 wt. %, about 0.004 wt. %, about 0.003 wt. %, about 0.002 wt. %, about 0.001 wt. %, or lower.

In various embodiments, the steel alloy further comprises molybdenum (Mo) at a concentration of greater than or equal to about 0 wt. % to less than or equal to about 0.8 wt. %, greater than or equal to about 0.01 wt. % to less than or equal to about 0.8 wt. %, or less than or equal to about 0.8 wt. %. For example, in various embodiments, the steel alloy is substantially free of Mo or comprises Mo at a concentration of less than or equal to about 0.8 wt. %, less than or equal to about 0.7 wt. %, less than or equal to about 0.6 wt. %, less than or equal to about 0.5 wt. %, less than or equal to about 0.4 wt. %, less than or equal to about 0.3 wt. %, less than or equal to about 0.2 wt. %, or less than or equal to about 0.1 wt. %, such as at a concentration of about 0.8 wt. %, about 0.7 wt. %, about 0.6 wt. %, about 0.5 wt. %, about 0.4 wt. %, about 0.3 wt. %, about 0.2 wt. %, about 0.1 wt. %, or lower.

In various embodiments, the steel alloy further comprises boron (B) at a concentration of greater than or equal to about 0 wt. % to less than or equal to about 0.005 wt. %, greater than or equal to about 0.0001 wt. % to less than or equal to about 0.005 wt. %, or less than or equal to about 0.005 wt. %. For example, in various embodiments, the steel alloy is substantially free of B or comprises B at a concentration of less than or equal to about 0.005 wt. %, less than or equal to about 0.004 wt. %, less than or equal to about 0.003 wt. %, less than or equal to about 0.002 wt. %, or less than or equal to about 0.001 wt. %, such as at a concentration of about 0.005 wt. %, about 0.004 wt. %, about 0.003 wt. %, about 0.002 wt. %, about 0.001 wt. %, about 0.0005 wt. %, about 0.0001 wt. %, or lower.

In various embodiments, the steel alloy further comprises niobium (Nb) at a concentration of greater than or equal to about 0 wt. % to less than or equal to about 0.3 wt. %, greater than or equal to about 0.01 to less than or equal to about 0.3 wt. %, or less than or equal to about 0.3 wt. %. For example, in various embodiments, the steel alloy is substantially free of Nb or comprises Nb at a concentration of less than or equal to about 0.3 wt. %, less than or equal to about 0.25 wt. %, less than or equal to about 0.2 wt. %, less than or equal to about 0.15 wt. %, or less than or equal to about 0.1 wt. %, such as at a concentration of about 0.3 wt. %, about 0.25 wt. %, about 0.2 wt. %, about 0.15 wt. %, about 0.1 wt. %, or lower.

In various embodiments, the steel alloy further comprises vanadium (V) at a concentration of greater than or equal to about 0 wt. % to less than or equal to about 0.3 wt. %, greater than or equal to about 0.01 to less than or equal to about 0.3 wt. %, or less than or equal to about 0.3 wt. %. For example, in various embodiments, the steel alloy is substantially free of V or comprises V at a concentration of less than or equal to about 0.3 wt. %, less than or equal to about 0.25 wt. %, less than or equal to about 0.2 wt. %, less than or equal to about 0.15 wt. %, or less than or equal to about 0.1 wt. %, such as at a concentration of about 0.3 wt. %, about 0.25 wt. %, about 0.2 wt. %, about 0.15 wt. %, about 0.1 wt. %, or lower.

The steel alloy can include various combinations of C, Cr, Si, Mn, N, Mo, B, Nb, V, and Fe at their respective concentrations described above. In some embodiments, the steel alloy consists essentially of C, Cr, Si, Mn, and Fe. As described above, the term "consists essentially of" means the steel alloy excludes additional compositions, materials, components, elements, and/or features that materially affect the basic and novel characteristics of the steel alloy, such as the steel alloy not requiring coatings or descaling when formed into a press-hardened steel component, but any compositions, materials, components, elements, and/or features that do not materially affect the basic and novel characteristics of the steel alloy can be included in the embodiment. Therefore, when the steel alloy consists essentially of C, Cr, Si, Mn, and Fe, the steel alloy can also include any combination of N, Mo, B, Nb, and V, as provided above, that does not materially affect the basic and novel characteristics of the steel alloy. In other embodiments, the steel alloy consists of C, Cr, Si, Mn, and Fe at their respective concentrations described above and at least one of N, Mo, B, Nb, and V at their respective concentrations described above. Other elements that are not described herein can also be included in trace amounts, i.e., amounts of less than or equal to about 1.5 wt. %, less than or equal to about 1 wt. %, less than or equal to about 0.5 wt. %, or amounts that are not detectable, provided that they do not materially affect the basic and novel characteristics of the steel alloy.

In one embodiment, the steel alloy consists essentially of C, Cr, Si, Mn, and Fe. In another embodiment, the steel alloy consists of C, Cr, Si, Mn, and Fe.

In one embodiment, the steel alloy consists essentially of C, Cr, Si, Mn, Mo, and Fe. In another embodiment, the steel alloy consists of C, Cr, Si, Mn, Mo, and Fe.

In one embodiment, the steel alloy consists essentially of C, Cr, Si, Mn, Mo, Nb, V, and Fe. In another embodiment, the steel alloy consists of C, Cr, Si, Mn, Mo, Nb, V, and Fe.

In one embodiment, the steel alloy consists essentially of C, Cr, Si, Mn, Mo, Nb, and Fe. In another embodiment, the steel alloy consists of C, Cr, Si, Mn, Mo, Nb, and Fe.

In one embodiment, the steel alloy consists essentially of C, Cr, Si, Mn, N, and Fe. In another embodiment, the steel alloy consists of C, Cr, Si, Mn, N, and Fe.

In one embodiment, the steel alloy consists essentially of C, Cr, Si, Mn, N, Mo, B, Nb, V, and Fe. In another embodiment, the steel alloy consists of C, Cr, Si, Mn, N, Mo, B, Nb, V, and Fe.

In one embodiment, the steel alloy consists essentially of C, Cr, Si, and Fe. In another embodiment, the steel alloy consists of C, Cr, Si, and Fe.

In one embodiment, the steel alloy consists essentially of C, Cr, Si, Mo, B, Nb, V, and Fe. In another embodiment, the steel alloy consists of C, Cr, Si, Mo, B, Nb, V, and Fe.

Figure 1:
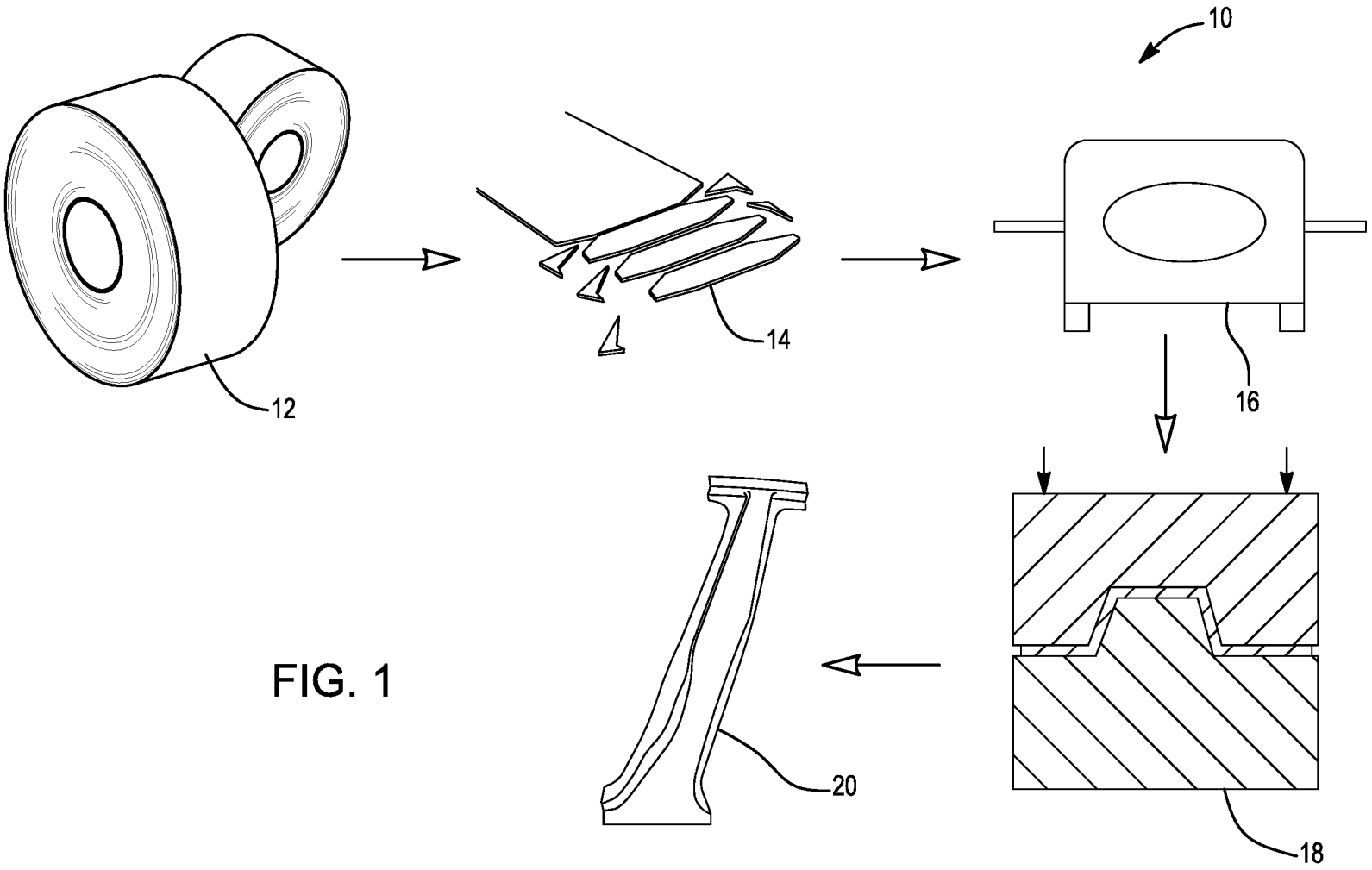
FIG. 1 is a flow diagram illustrating a method of making a press-hardened steel structure according to various aspects of the current technology.

With reference to FIG. 1, the current technology also provides a method 10 of fabricating a press-hardened steel component. More particularly, the method includes hot pressing the steel alloy described above to form the press-hardened steel component. The steel alloy is processed in a bare form, i.e., without any coatings, such as Al—Si or Zn (galvanized) coatings. Moreover, the method is free from a descaling step, i.e., free from shot blasting, sand blasting, or any other method for preparing a smooth and homogenous surface. The press-hardened steel component can be any component that is generally made by hot stamping, such as, a vehicle part, for example. Non-limiting examples of vehicles that have parts suitable to be produced by the current method include bicycles, automobiles, motorcycles, boats, tractors, buses, mobile homes, campers, gliders, airplanes, and tanks. In various embodiments, the press-hardened steel component is an automobile part selected from the group consisting of a pillar, a bumper, a roof rail, a rocker rail, a rocker, a control arm, a beam, a tunnel, a beam, a step, a subframe member, and a reinforcement panel.

The method 10 comprises obtaining a coil 12 of a steel alloy according to the present technology and cutting a blank 14 from the coil 12. Although not shown, the blank 14 can alternatively be cut from a sheet of the steel alloy. The steel alloy is bare, i.e., uncoated. The method 10 also comprises hot pressing the blank 14. In this regard, the method 10 comprises austenitizing the blank 14 by heating the blank 14 in a furnace 16 to a temperature above its upper critical temperature (Ac3) temperature to fully austenitize the steel alloy. The heated blank 14 is transferred to a die or press 18, optionally by a robotic arm (not shown). Here, the method 10 comprises stamping the blank 14 in the die or press 18 to form a structure having a predetermined shape and quenching the structure at a rate to a temperature less than or equal to about a martensite finish ($M_f$) temperature of the steel alloy and greater than or equal to about room temperature to form the press-hardened steel component. The quenching comprises decreasing the temperature of the structure at a rate of greater than or equal to about 15° C./s.

The method 10 is free of a descaling step. As such, the method 10 does not include, for example, steps of shot blasting or sand blasting. Inasmuch as the steel alloy is bare, the press-hardened steel component is free of and does not include, for example, a layer of zinc (Zn) or an aluminum-silicon (Al—Si) coating. The method 10 is also free of a secondary heat treatment after the quenching. As discussed in more detail below, the press-hardened steel component comprises press-hardened steel comprising an alloy matrix (having the components of the steel alloy), a first layer comprising an oxide enriched with Cr and Si derived from the alloy composition, and an optional second layer comprising an oxide enriched with Fe derived from the alloy composition.

Figure 2:
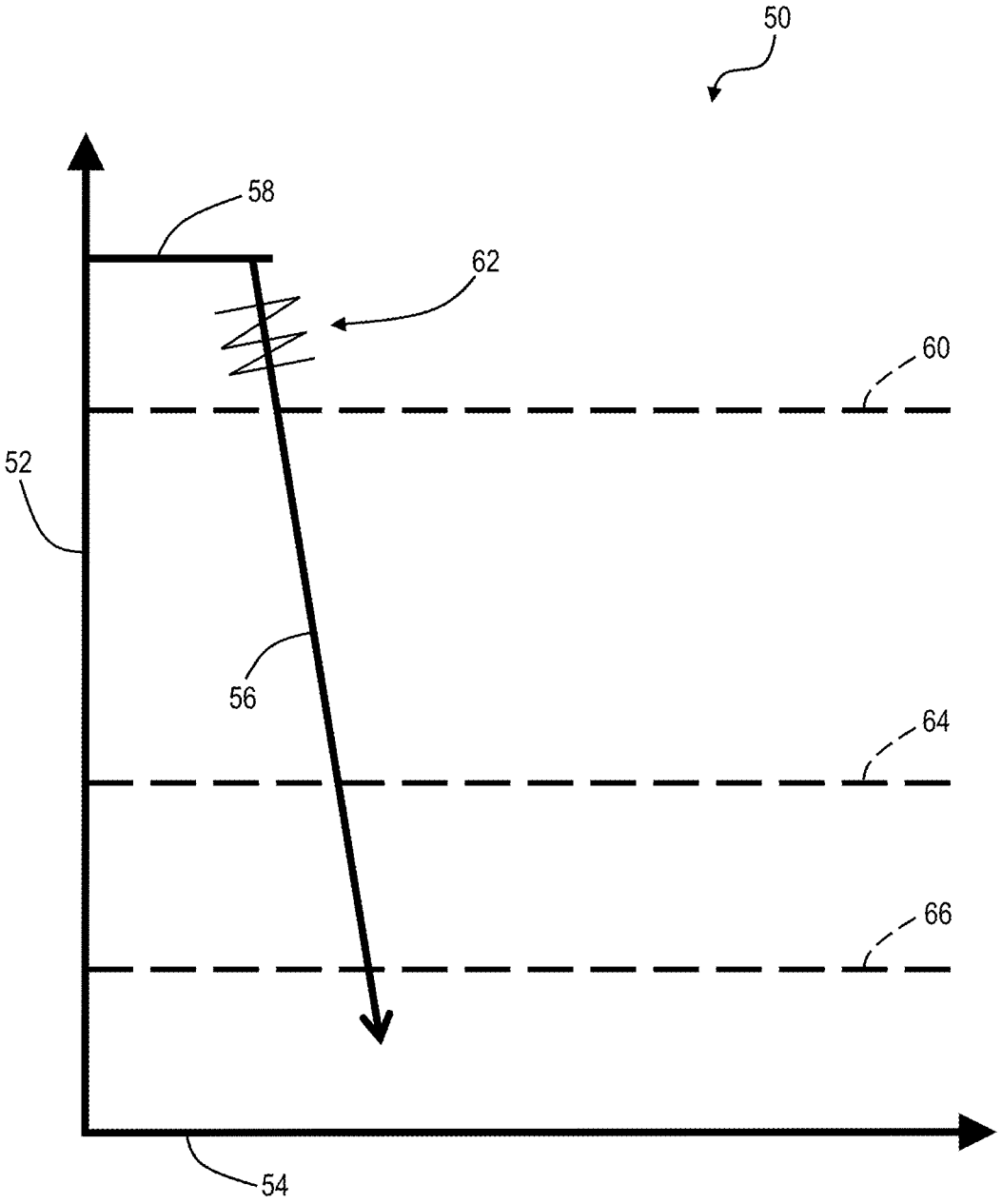
FIG. 2 is a graph showing temperature versus time for a hot pressing method used to process a steel alloy according to various aspects of the current technology.

FIG. 2 shows a graph 50 that provides additional details about the hot pressing. The graph 50 has a y-axis 52 representing temperature and an x-axis 54 representing time. A line 56 on the graph 50 represents heating conditions during the hot pressing. Here, the blank is heated to a final temperature 58 that is above an upper critical temperature (Ac3) 60 of the steel alloy to fully austenitize the steel alloy. The final temperature 58 is greater than or equal to about 880° C. to less than or equal to about 950° C. The austenitized blank is then stamped or hot-formed into the structure having the predetermined shape at a stamping temperature 62 between the final temperature 58 and Ac3 60 and then cooled at a rate of greater than or equal to about 15° $Cs^{-1}$, greater than or equal to about 20° $Cs^{-1}$, greater than or equal to about 25° $Cs^{-1}$, or greater than or equal to about 30° $Cs^{-1}$, such as at a rate of about 15° $Cs^{-1}$, about 18° $Cs^{-1}$, about 20° $Cs^{-1}$, about 22° $Cs^{-1}$, about 24° $Cs^{-1}$, about 26° $Cs^{-1}$, about 28° $Cs^{-1}$, about 30° $Cs^{-1}$, or faster, until the temperature decreases below a martensite start ($M_s$) temperature 64 and below a martensite finish ($M_f$) temperature 66, such that the press-hardened steel alloy matrix of the resulting press-hardened structure has a microstructure that is greater than or equal to about 95% martensite and such that the first layer and optional second layer are formed. As discussed above, when the first and second layers are both formed during hot stamping, the first layer may be formed prior to the formation of the second layer, the second layer may be formed prior to the formation of the first layer, or the first and second layers may be formed simultaneously. In various embodiments, the hot pressing, i.e., the heating, stamping, and quenching, is performed in an aerobic atmosphere. The aerobic atmosphere provides oxygen that forms the oxides in the first and second layers. Therefore, to decrease the thickness of the optional second layer, or to avoid its formation, the hot pressing can be performed in an anaerobic atmosphere, such as by supplying an inert gas into at least one of the oven or the die. The inert gas can be any inert gas known in the art, such as nitrogen or argon, as non-limiting examples. The quench rate and the final temperature 58 can also be adjusted in order to influence the presence or size of the optional second layer.

Figure 3:
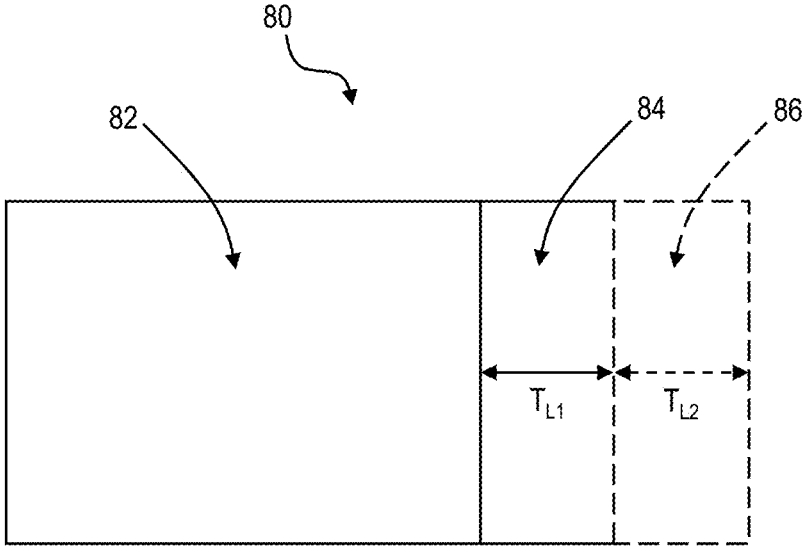
FIG. 3 is an illustration of a press-hardened steel according to various aspects of the current technology.

With reference to FIG. 3, the current technology yet further provides a press-hardened steel 80. The press-hardened steel 80 results from hot pressing the steel alloy described above by the method described above. As such, the press-hardened steel structure made by the above method is composed of the press-hardened steel 80.

The press-hardened steel 80 comprises an alloy matrix 82, a first layer 84, and an optional second layer 86. It is understood that FIG. 3 only shows a cross section illustration of a portion of the press-hardened steel 80 and that the first layer 84 and the optional second layer 86 surround the alloy matrix 82. The press-hardened steel 80 has an ultimate tensile strength (UTS) of greater than or equal to about 500 MPa, greater than or equal to about 750 MPa, greater than or equal to about 1,000 MPa, greater than or equal to about 1,250 MPa, greater than or equal to about 1,600 MPa, greater than or equal to about 1,700 MPa, or greater than or equal to about 1,800 MPa. In some embodiments, the press-hardened steel 80 has a UTS of greater than or equal to about 1,600 MPa and less than or equal to about 2000 MPa.

The alloy matrix 82 comprises the composition of the steel alloy described above, but has a microstructure that is greater than or equal to about 95 wt. % martensite.

The first layer 84 is disposed directly on the alloy matrix 82 during the hot pressing process and comprises an oxide enriched with Cr and Si, including Cr oxides and Si oxides. In the first layer 84, the oxide enriched with Cr has a concentration of greater than or equal to about 1 wt. % to less than or equal to about 30 wt. %, such as a concentration of about 1 wt. %, about 2 wt. %, about 4 wt. %, about 6 wt. %, about 8 wt. %, about 10 wt. %, about 12 wt. %, about 14 wt. %, about 16 wt. %, about 18 wt. %, about 20 wt. %, about 22 wt. %, about 24 wt. %, about 26 wt. %, about 28 wt. %, or about 30 wt. %. In the first layer 84, the oxide enriched with Si has a concentration of greater than or equal to about 1 wt. % to less than or equal to about 30 wt. %, such as a concentration of about 1 wt. %, about 2 wt. %, about 4 wt. %, about 6 wt. %, about 8 wt. %, about 10 wt. %, about 12 wt. %, about 14 wt. %, about 16 wt. %, about 18 wt. %, about 20 wt. %, about 22 wt. %, about 24 wt. %, about 26 wt. %, about 28 wt. %, or about 30 wt. %, The Cr and Si in the first layer 84 originate within and migrate from the alloy matrix 82 into the oxide. In this regard, the Cr and Si of the enriched oxide of the first layer 84 are derived from the steel alloy or the alloy matrix 82. Put another way, the first layer 84 is formed from portions of the Cr and the Si included in the steel alloy or the alloy matrix 82.

The first layer 84 has a thickness Tu of greater than or equal to about 0.01 μm to less than or equal to about 10 μm, such as a thickness of about 0.01 μm, about 0.05 μm, about 0.1 μm, about 0.15 μm, about 0.25 μm, about 0.3 μm, about 0.35 μm, about 0.4 μm, about 0.45 μm, about 0.5 μm, about 0.55 μm, about 0.6 μm, about 0.65 μm, about 0.7 μm, about 0.75 μm, about 0.8 μm, about 0.85 μm, about 0.9 μm, about 0.95 μm, about 1 μm, about 1.5 μm, about 2 μm, about 2.5 μm, about 3 μm, about 3.5 μm, about 4 μm, about 4.5 μm, about 5 μm, about 5.5 μm, about 6 μm, about 6.5 μm, about 7 μm, about 7.5 μm, about 8 μm, about 8.5 μm, about 9 μm, about 9.5 μm, or about 10 μm.

In certain variations, the first layer 84 is continuous and homogenous. Therefore, in embodiments where the second layer 86 is absent, the first layer 84 provides an exposed surface, and there is no need for it to be descaled by, for example, shot blasting or sand blasting. Moreover, when the second layer 86 is absent, the first layer 84 prevent, inhibits, or minimizes further surface oxidation.

When processed under various conditions as discussed above, the press-hardened steel 80 comprises the second layer 86. The second layer 86 is disposed directly on the first layer 84 during the hot pressing process and comprises an oxide enriched with Fe. In various embodiments, the oxide enriched with Fe comprises FeO, $Fe_2O_3$, $Fe_3O_4$, or a combination thereof. In the second layer 86, the oxide enriched with Fe has a concentration of Fe of greater than or equal to about 10 wt. %, greater than or equal to about 15 wt. %, greater than or equal to about 20 wt. %, greater than or equal to about 25 wt. %, or greater than or equal to about 30 wt. %. The Fe in the second layer 86 originates within and migrates from the alloy matrix 82 into the oxide. In this regard, the Fe of the second layer 86 is derived from the steel alloy or the alloy matrix 82. Put another way, the second layer 86 is formed from a portion of the Fe included in the steel alloy or the alloy matrix 82.

The second layer 86 has a thickness $T_{L2}$ of greater than or equal to about 0 μm to less than or equal to about 30 μm or greater than or equal to about 0.01 μm to less than or equal to about 30 μm, such as a thickness of about 0.01 μm, about 0.05 μm, about 0.1 μm, about 0.15 μm, about 0.25 μm, about 0.3 μm, about 0.35 μm, about 0.4 μm, about 0.45 μm, about 0.5 μm, about 0.55 μm, about 0.6 μm, about 0.65 μm, about 0.7 μm, about 0.75 μm, about 0.8 μm, about 0.85 μm, about 0.9 μm, about 0.95 μm, about 1 μm, about 1.5 μm, about 2 μm, about 2.5 μm, about 3 μm, about 3.5 μm, about 4 μm, about 4.5 μm, about 5 μm, about 5.5 μm, about 6 μm, about 6.5 μm, about 7 μm, about 7.5 μm, about 8 μm, about 8.5 μm, about 9 μm, about 9.5 μm, about 10 μm, about 12 μm, about 14 μm, about 16 μm, about 18 μm, about 20 μm, about 22 μm, about 24 μm, about 26 μm, about 28 μm, or about 30 μm.

The second layer 86 is continuous and homogenous. Therefore, the second layer 86 provides an exposed surface, and there is no need for it to be descaled by, for example, shot blasting or sand blasting. Moreover, the second layer 86 prevent, inhibits, or minimizes further surface oxidation.

As discussed above, when the first and second layers 84, 86 are both formed during hot stamping, the first layer 84 may be formed prior to the formation of the second layer 86, the second layer 86 may be formed prior to the formation of the first layer 84, or the first and second layers 84, 86 may be formed simultaneously.

Figure 4A:
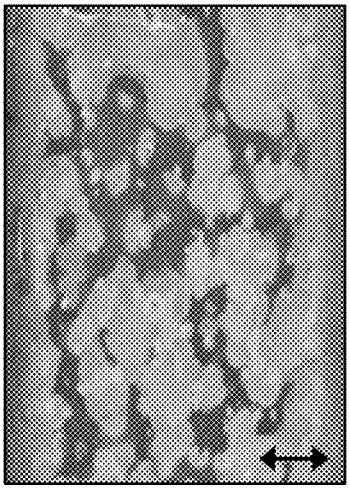
FIGS. 4A-4C show surfaces of a hot-pressed bare 22MnB5 steel (FIG. 4A), a hot-pressed Al—Si coated 22MnB5 steel (FIG. 4B), and a hot-pressed 3Cr1.5Si steel (FIG. 4C) prepared according to various aspects of the current technology. The scale bars in FIGS. 4A and 4B are 10 mm, and the scale bar in FIG. 4C is 5 mm.
Figure 4B:
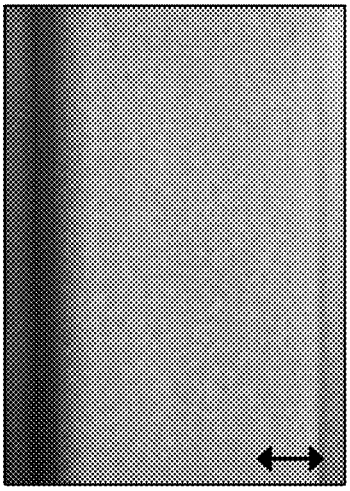
Figure 4C:
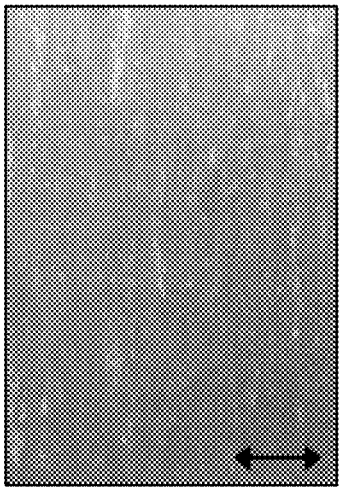

The press-hardened steel 80 does not include or is free of any layer that is not derived from the steel alloy or the alloy matrix 82, as discussed above. Nonetheless, it does not require descaling. FIG. 4A, for example, is an image of a surface of a first comparative press-hardened steel that is formed from a bare 22MnB5 alloy. As can be seen in the image, the surface is highly oxidized and rough (the oxidized portions are about 15-40 μm thick); therefore, descaling is required in order to provide a surface that can adhere to a substrate and be electro-coated, painted, or welded. FIG. 4B is an image of a surface of a second comparative press-hardened steel that is formed from a 22MnB5 alloy having an Al—Si coating, and FIG. 4C is an image of a press-hardened steel made in accordance with the current technology from a bare steel alloy comprising 3 wt. % Cr and 1.5 wt. % Si (3Cr1.5Si). Only the press-hardened steel made in accordance with the current technology has a uniform, homogenous surface that resists oxidation, does not include an exogenous coating, i.e., a coating that is not derived from the steel alloy or matrix, and does not require descaling.

FIGS. 5A-5G show the effect that including both Cr and Si in the steel alloy has on the press-hardened steel. FIG. 5A is an image of a surface of a press-hardened steel made from an alloy comprising 3 wt. % Cr and no Si (3Cr0Si). As can be seen in the image, the surface is oxidized and rough. FIG. 5B is a Cr SEM-EDS map made from a cross section of the 3Cr0Si steel. This image shows a steel matrix 100 and a Cr-enriched oxide layer 102. FIG. 5C is an image of a surface of a press-hardened steel made from an alloy comprising 1.8 wt. % Si and no Cr (0Cr1.8Si). As can be seen in the image, the surface is oxidized and rough. FIG. 5D is a Si SEM-EDS map made from a cross section of the 0Cr1.8Si steel. This image shows a steel matrix 104 and a Si-enriched oxide layer 106. FIG. 5E is an image of a surface of the press-hardened steel made from the 3Cr1.5Si alloy, i.e., the same press-hardened steel shown in FIG. 4C and prepared in accordance with the current technology. As can be seen in the image, the surface is smooth, uniform, and homogenous. FIGS. 5F and 5G show a Cr SEM-EDS map and a Si SEM-EDS map, respectfully. FIG. 5F shows an alloy matrix 108 and a Cr-enriched layer 110. FIG. 5G shows the alloy matrix 108 and a Si-enriched layer 112. The Cr-enriched layer 110 and the Si-enriched layer 112 overlap, which demonstrates that they are present in the same layer and that the smooth, uniform, and homogenous surface is a result of having both Cr and Si in the steel alloy.

FIG. 6 shows a micrograph of the press-hardened steel hot stamped from the bare 3Cr1.5Si alloy, which includes an alloy matrix 120, a first layer 122, and a second layer 12. The micrograph is disposed over a graph having a y-axis 126 representing concentration (in wt. %) and an x-axis 128 representing distance (in μm). The concentration of Fe 130, Cr 132, Si 134, O 136, and Mn 138 can be determined in the alloy matrix 120, in the first layer 122, and in the second layer 124. The graph shows that there are consistent concentrations of the Fe 130, Cr 132, Si 134, O 136, and Mn 138 in the alloy matrix 120. The first layer 122 is characterized by a decrease in the Fe 130 and increases in the Cr 132, Si 134, and O 136. The second layer 124 is characterized by an increase in the Fe 130 (relative to the first layer 122), a maintained rise in the O 136, and a return to baseline for the Cr 132 and Si 134. The concentration of the Mn 138 is consistent in the alloy matrix 120, the first layer 122, and the second layer 124. Accordingly, FIG. 6 shows that the alloy matrix 120 includes substantially consistent levels of each of the Fe 130, Cr 132, Si 134, O 136, and Mn 138; the first layer 122 is enriched with the Cr 132, Si 134, and O 136; and the second layer 124 is enriched with the Fe 130 and O 136.

FIG. 7A is a micrograph of a cross section of a press-hardened steel hot pressed from a steel alloy of the current technology comprising 3 wt. % Cr and 0.6 wt. % Si (3Cr0.6Si). An alloy matrix 140, a first layer 142, and a second layer 144 are visible in the cross section. FIGS. 7B, 7C, 7D, and 7E show Fe, O, Si, and Cr SEM-EDS maps, respectively. These images show that the alloy matrix 140 includes Fe, Si, Cr, and some O. In addition, it is shown that the first layer 142 includes relatively higher amounts of O, Cr, and Si, and the second layer 144 includes relatively higher amounts of O and Fe.

FIG. 8 shows another micrograph of the press-hardened steel processed from the 3Cr0.6Si steel alloy. The micrograph shows the alloy matrix 140, the first layer 142, and the second layer 144. The micrograph is disposed over a graph having a y-axis 146 representing concentration (in counts per second (cps)) and an x-axis 148 representing distance (in μm). The concentration of Fe 150, Cr 152, Si 154, O 156, and Mn 158 can be determined in the alloy matrix 140, in the first layer 142, and in the second layer 144. The graph shows that there are consistent concentrations of the Fe 150, Cr 152, Si 154, O 156, and Mn 158 in the alloy matrix 140. The first layer 142 is characterized by a decrease in the Fe 150 and increases in the Cr 152, Si 154, and O 156. The second layer 144 is characterized by an increase in the Fe 150 (relative to the first layer 142) and O 156 and a return to baseline for the Cr 152 and Si 154. The concentration of the Mn 158 is consistent in the alloy matrix 140, the first layer 142, and the second layer 144. Accordingly, FIG. 8 shows that the alloy matrix 140 includes substantially consistent levels of each of the Fe 150, Cr 152, Si 154, O 156, and Mn 158; the first layer 142 is enriched with the Cr 152, Si 154, and O 156; and the second layer 144 is enriched with the Fe 150 and O 156.

FIG. 9A is a micrograph of a cross section of a press-hardened steel hot pressed from a steel alloy of the current technology comprising 2 wt. % Cr and 1.5 wt. % Si (2Cr1.5Si). An alloy matrix 160, a first layer 162, and a second layer 164 are visible in the cross section. FIGS. 9B, 9C, 9D, and 9E show Fe, O, Cr, and Si SEM-EDS maps, respectively. These images show that the alloy matrix 160 includes Fe, Si, Cr, and some O. These images also show that the first layer 162 includes relatively higher amounts of O, Cr, and Si, and the second layer 164 includes relatively higher amounts of O and Fe.

FIG. 10A is a micrograph of a cross section of a press-hardened steel hot pressed from a steel alloy of the current technology comprising 3 wt. % Cr and 1.5 wt. % Si (3Cr1.5Si). Here, the press-hardened steel is fabricated by heating in a furnace, stamping in a die, and air cooling (as opposed to die quenching) in a low oxygen atmosphere. Similar results are obtainable by performing the method with die quenching and using an inert atmosphere, i.e., an atmosphere of $N_2$ gas. An alloy matrix 170 and a first layer 172 are visible in the cross section. FIGS. 10B, 10C, 10D, 10E, and 10F show Fe, O, Cr, Si, and Mn SEM-EDS maps, respectively. These images show that the alloy matrix 170 includes Fe, Si, Cr, Mn, and some O and that the first layer 172 includes relatively higher amounts of O, Cr, and Si. There is no second layer in the press-hardened steel.

FIG. 11 shows another micrograph of the press-hardened steel processed from the 3Cr1.5Si steel alloy. The micrograph shows the alloy matrix 170 and the first layer 172. The micrograph is disposed over a graph having a y-axis 176 representing concentration (in wt. %) and an x-axis 178 representing distance (in μm). The concentration of Fe 180, Cr 182, Si 184, O 186, and Mn 188 can be determined in the alloy matrix 170 and in the first layer 172. The graph shows that there are consistent concentrations of the Fe 180, Cr 182, Si 184, O 186, and Mn 188 in the alloy matrix 170. The first layer 172 is characterized by a relative decrease in the Fe 180 and relative increases in the Cr 182, Si 184, and O 186. Accordingly, FIG. 11 shows that the alloy matrix 170 includes substantially consistent levels of each of the Fe 180, Cr 182, Si 184, O 186, and Mn 188; and the first layer 172 is enriched with the Cr 182, Si 184, O 186, and even some Mn 188.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A press-hardened steel comprising:
an alloy matrix comprising:
carbon (C) at a concentration of greater than or equal to about 0.01 wt. % to less than or equal to about 0.35 wt. %,
chromium (Cr) at a concentration of greater than or equal to about 2.2 wt. % to less than or equal to about 9 wt. %,
silicon (Si) at a concentration of greater than or equal to about 1.1 wt. % to less than or equal to about 2 wt. %, and
a balance of iron (Fe), the alloy matrix being greater than or equal to about 95 vol. % martensite;
a first layer disposed directly on the alloy matrix, the first layer being continuous, having a first thickness of greater than or equal to about 0.01 micrometer to less than or equal to about 10 micrometers, and comprising an oxide enriched with Cr and Si; and
a second layer disposed directly on the first layer, the second layer being continuous, having a second thickness of greater than or equal to about 0.01 micrometers to less than or equal to about 30 micrometers, and comprising an oxide enriched with Fe.

2. The press-hardened steel according to claim 1, wherein the alloy matrix further comprises:
manganese (Mn) at a concentration of greater than or equal to about 0.01 wt. % to less than or equal to about 3 wt. %,
molybdenum (Mo) at a concentration of greater than or equal to about 0.01 wt. % to less than or equal to about 0.8 wt. %,
niobium (Nb) at a concentration of greater than or equal to about 0.01 wt. % to less than or equal to about 0.3 wt. %,
vanadium (V) at a concentration of greater than or equal to about 0.01 wt. % to less than or equal to about 0.3 wt. %, or
a mixture thereof.

3. The press-hardened steel according to claim 2, wherein the alloy matrix further comprises:
boron (B) at a concentration of less than or equal to about 0.005 wt. %, and
nitrogen (N) at a concentration of less than or equal to about 0.01 wt. %.

4. The press-hardened steel according to claim 1, wherein the alloy matrix comprises the Cr at a concentration of greater than or equal to about 2.2 wt. % to less than or equal to about 3 wt. % and the Si at a concentration of greater than or equal to about 1.1 wt. % to less than or equal to about 1.8 wt. %.

5. The press-hardened steel according to claim 1, wherein the oxide of the first layer is enriched with the Cr at a concentration of at greater than or equal to about 1 wt. % to less than or equal to about 30 wt. % and the Si at a concentration of at greater than or equal to about 1 wt. % to less than or equal to about 30 wt. %.

6. The press-hardened steel according to claim 1, wherein the first layer is formed from the Cr and the Si of the alloy matrix, and the press-hardened steel is free of any layers not having an element derived from the alloy matrix.

7. The press-hardened steel according to claim 1, wherein the oxide enriched with the Fe comprises FeO, $Fe_2O_3$, $Fe_3O_4$, or a combination thereof.

8. The press-hardened steel according to claim 1, wherein the press-hardened steel is in the form of a vehicle part.

9. A press-hardened steel comprising:
an alloy matrix comprising:
carbon (C) at a concentration of greater than or equal to about 0.01 wt. % to less than or equal to about 0.35 wt. %,
chromium (Cr) at a concentration of greater than or equal to about 2.2 wt. % to less than or equal to about 9 wt. %,
silicon (Si) at a concentration of greater than or equal to about 1.1 wt. % to less than or equal to about 2 wt. %, and
a balance of iron (Fe), the alloy matrix being greater than or equal to about 95 vol. % martensite;
a first layer disposed directly on the alloy matrix, the first layer being continuous, having a first thickness of greater than or equal to about 0.01 micrometer to less than or equal to about 10 micrometers, and comprising an oxide enriched with Cr and Si; and
a second layer disposed directly on the first layer, the second layer being continuous and homogenous, having a second thickness greater than or equal to about 0.01 micrometer to less than or equal to about 30 micrometers, and comprising FeO, $Fe_2O_3$, $Fe_3O_4$, or a combination thereof,
wherein the first layer and the second layer are derived from the alloy matrix during press hardening, and
wherein the press-hardened steel is free of any layer or coating not having an element derived from the alloy matrix.

10. The press-hardened steel according to claim 9, wherein the press-hardened steel has an ultimate tensile strength (UTS) of greater than or equal to about 500 MPa.

11. A method of fabricating a press-hardened steel component, the method comprising:
cutting a blank from a steel alloy, the steel alloy being uncoated and comprising:

carbon (C) at a concentration of greater than or equal to about 0.01 wt. % to less than or equal to about 0.35 wt. %, chromium (Cr) at a concentration of greater than or equal to about 2.2 wt. % to less than or equal to about 9 wt. %, silicon (Si) at a concentration of greater than or equal to about 1.1 wt. % to less than or equal to about 2 wt. %, and a balance of iron (Fe);

heating the blank to a temperature greater than or equal to about 880° C. to less than or equal to about 950° C. to fully austenitize the steel alloy;

stamping the blank in a die to form a structure having a predetermined shape from the blank; and quenching the structure to a temperature less than or equal to about a martensite finish ($M_f$) temperature of the steel alloy and greater than or equal to about room temperature to form the press-hardened steel component, wherein the press-hardened steel component comprises:

an alloy matrix including the C, Cr, Si, and Fe of the steel alloy;

a first layer disposed directly on the alloy matrix, the first layer being continuous, having a first thickness of greater than or equal to about 0.01 micrometer to less than or equal to about 10 micrometers, and comprising an oxide enriched with portions of the Cr and of the Si of the steel alloy; and a second layer disposed directly on the first layer, the second layer being continuous and homogenous, having a second thickness of greater than or equal to about 0.01 micrometer μm to less than or equal to about 30 micrometers, and comprising an oxide enriched with a portion of the Fe of the steel alloy, wherein the method is free of a descaling step, and wherein the press-hardened steel component is free of a layer of zinc (Zn) or an aluminum-silicon (Al—Si) coating.

12. The method according to claim 11, wherein the quenching comprises decreasing the temperature of the structure at a rate of greater than or equal to about 15° C./s.

13. The method according to claim 11, wherein the oxide enriched with the portion of the Fe of the steel alloy of the second layer comprises FeO, $Fe_2O_3$, $Fe_3O_4$, or a combination thereof.

14. The method according to claim 11, wherein the heating, the stamping, and the quenching are performed in an anaerobic atmosphere.

15. The method according to claim 11, wherein the alloy matrix comprises greater than or equal to about 95 vol. % martensite.

16. The method according to claim 11, wherein the method is free of a secondary heat treatment after the quenching.

17. The method according to claim 11, wherein the press-hardened steel component is an automobile part selected from the group consisting of a pillar, a bumper, a roof rail, a rocker rail, a rocker, a control arm, a beam, a tunnel, a beam, a step, a subframe member, and a reinforcement panel.

* * * * *